US010974920B2

(12) United States Patent
Miyahara et al.

(10) Patent No.: US 10,974,920 B2
(45) Date of Patent: Apr. 13, 2021

(54) CONTROL DEVICE FOR CONTROLLING AN IMAGE FORMING SYSTEM

(71) Applicant: CANON KABUSHIKI KAISHA, Tokyo (JP)

(72) Inventors: Nobuaki Miyahara, Moriya (JP); Ryo Fujita, Tokyo (JP); Toru Shinnae, Kashiwa (JP); Yoshitaka Oba, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 176 days.

(21) Appl. No.: 15/982,779

(22) Filed: May 17, 2018

(65) Prior Publication Data

US 2018/0334349 A1 Nov. 22, 2018

(30) Foreign Application Priority Data

May 22, 2017 (JP) ..... JP2017-101134
Dec. 20, 2017 (JP) ..... JP2017-243732

(51) Int. Cl.
*B65H 31/10* (2006.01)
*B65H 43/06* (2006.01)
(Continued)

(52) U.S. Cl.
CPC ..... *B65H 31/10* (2013.01); *B65H 31/22* (2013.01); *B65H 43/06* (2013.01);
(Continued)

(58) Field of Classification Search
CPC ..... B65H 31/10; B65H 43/06; B65H 31/22; G03G 15/6538; G03G 15/6529; G03G 15/5016
See application file for complete search history.

(56) References Cited

U.S. PATENT DOCUMENTS 8,055,183 B2 11/2011 Inenaga
8,177,222 B2 5/2012 Yaginuma
(Continued)

FOREIGN PATENT DOCUMENTS

CN 101135959 A 3/2008
CN 101867719 A 10/2010
(Continued)

*Primary Examiner* — Patrick H Mackey
(74) *Attorney, Agent, or Firm* — Canon U.S.A., Inc. I.P. Division

(57) ABSTRACT

A control device, to control a system having an image forming apparatus to form an image on a sheet based on an image forming job and a sheet discharge apparatus having stacking trays for the sheet, includes a storage storing stacking state information for each stacking tray, a generator, a display controller, and an input portion. The generator generates a system configuration image, and a sheet bundle image representing a sheet bundle stacked on each stacking tray based on the stored stacking state information. The display controller displays a screen in which the sheet bundle image is combined at a position of each stacking tray in the system configuration image. The input portion inputs designation of an image forming job corresponding to sheets to be taken out. The display controller displays an order of taking out the sheets corresponding to the image forming job designated through the input portion.

11 Claims, 22 Drawing Sheets

(51) Int. Cl.
*B65H 31/22* (2006.01)
*G03G 15/00* (2006.01)

(52) U.S. Cl.
CPC ..... *G03G 15/5016* (2013.01); *G03G 15/6529* (2013.01); *G03G 15/6538* (2013.01); *B65H 2220/02* (2013.01); *G03G 2215/00556* (2013.01); *G03G 2215/00822* (2013.01)

(56) References Cited

U.S. PATENT DOCUMENTS

| | | | | |
|---|---|---|---|---|
| 9,242,829 | B2 | 1/2016 | Miyajima | |
| 2001/0054793 | A1 | 12/2001 | Nakahira | |
| 2001/0054799 | A1* | 12/2001 | McComb | F16J 15/104 277/590 |
| 2005/0017426 | A1* | 1/2005 | Hirata | B65H 37/00 270/58.08 |
| 2006/0082818 | A1 | 4/2006 | Kasamatsu | |
| 2006/0261543 | A1 | 11/2006 | Miyake | |
| 2006/0285869 | A1* | 12/2006 | Kushida | G03G 15/502 399/81 |
| 2008/0055637 | A1 | 3/2008 | Hatakeyama | |
| 2008/0178120 | A1 | 7/2008 | Yamamoto | |
| 2008/0246989 | A1 | 10/2008 | Konuma | |
| 2009/0041482 | A1* | 2/2009 | Inenaga | G03G 15/502 399/23 |
| 2010/0251170 | A1* | 9/2010 | Louch | G06F 16/95 715/810 |
| 2011/0075195 | A1 | 3/2011 | Cain | |
| 2011/0157642 | A1 | 6/2011 | Nemoto | |
| 2011/0211888 | A1* | 9/2011 | Fujinaga | B41J 13/0009 399/403 |
| 2013/0334771 | A1 | 12/2013 | Igarashi | |
| 2014/0293329 | A1 | 10/2014 | Shimizu | |
| 2015/0098101 | A1 | 4/2015 | Asakawa | |
| 2016/0031669 | A1 | 2/2016 | Mori | |
| 2016/0052320 | A1 | 2/2016 | Mutsuno | |
| 2016/0162222 | A1 | 6/2016 | De Boer | |
| 2018/0334350 | A1* | 11/2018 | Fukuda | G03G 15/6529 |

FOREIGN PATENT DOCUMENTS

| | | | |
|---|---|---|---|
| CN | 101873430 | A | 10/2010 |
| CN | 102166896 | A | 8/2011 |
| CN | 102189775 | A | 9/2011 |
| CN | 102207950 | A | 10/2011 |
| CN | 102365635 | A | 2/2012 |
| CN | 103508245 | A | 1/2014 |
| CN | 103863876 | A | 6/2014 |
| CN | 104555541 | A | 4/2015 |
| CN | 106183484 | A | 12/2016 |
| JP | 2002362821 | A | 12/2002 |
| JP | 2009137186 | A | 6/2009 |
| JP | 2012093601 | A | 5/2012 |
| JP | 2013146898 | A | 8/2013 |
| JP | 2014098875 | A | 5/2014 |

* cited by examiner

132

601

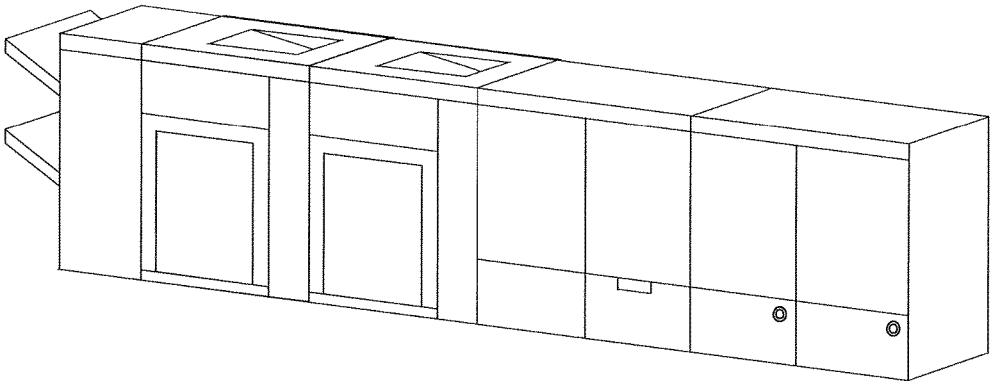

621 622 623

| STACKING TRAY | SHEET DISCHARGE APPARATUS | TRAY TYPE | TRAY POSITION COORDINATES |
|---|---|---|---|
| TRAY #1 | LARGE-CAPACITY STACKER (320) | TOP TRAY | (396, 102) |
| TRAY #2 | LARGE-CAPACITY STACKER (320) | LIFT TRAY | (376, 177) |
| TRAY #3 | LARGE-CAPACITY STACKER (320) | EJECTION TRAY | (347, 277) |
| TRAY #4 | LARGE-CAPACITY STACKER (340) | TOP TRAY | (257, 85) |
| TRAY #5 | LARGE-CAPACITY STACKER (340) | LIFT TRAY | (237, 160) |
| TRAY #6 | LARGE-CAPACITY STACKER (340) | EJECTION TRAY | (208, 260) |
| TRAY #7 | FINISHER (360) | UPPER TRAY | (92, 82) |
| TRAY #8 | FINISHER (360) | LOWER TRAY | (92, 155) |

FIG. 6

PROCESSED-JOB LIST

| JOB ID | JOB NAME | PROCESSING DAY/TIME | NUMBER OF PAGES | NUMBER OF BUNDLES | USED SHEET |
|---|---|---|---|---|---|
| 00000001 | IMAGE FORMING JOB #1 | 2011/08/13 13:52:21 JST | 5 | 100 | ABC PAPER C081 |
| 00000002 | IMAGE FORMING JOB #2 | 2011/08/13 14:09:02 JST | 20 | 5 | ABC PAPER C082 |
| 00000003 | IMAGE FORMING JOB #3 | 2011/08/21 09:11:43 JST | 20 | 30 | ABC PAPER C081 |
| 00000004 | IMAGE FORMING JOB #4 | 2011/08/22 10:34:28 JST | 60 | 500 | DEF PAPER/PLAIN PAPER |
| 00000005 | IMAGE FORMING JOB #5 | 2011/08/22 16:46:27 JST | 100 | 1 | XYZ PAPER/PLAIN PAPER |
| | | | | | |

FIG. 14A

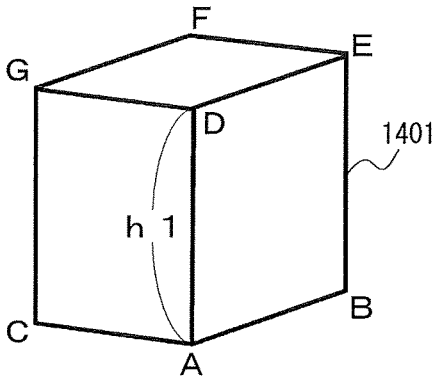

FIG. 14B

1402

| | COORDINATE POSITION |
|---|---|
| A | TRAY POSITION COORDINATES (x, y) |
| B | x+33 , y-13 |
| C | x-35 , y-5 |
| D | x, y-h1 |
| E | x+33 , y-h1-13 |
| F | x-5 , y-h1-17 |
| G | x-35 , y-h1-5 |

FIG. 14C

1403

```
<path stroke="black" stroke-width="1" fill="white" fill-opacity="0.7" d="M x (y-h1) L (x+33) (y-h1-13) L (x-5) (y-h1-17) L (x-35) (y-h1-5) Z"/>
<path stroke="black" stroke-width="1" fill="white" fill-opacity="0.7" d="M x (y-h1) L (x-35) (y-h1-5) L (x-35) (y-5) L x y Z"/>
<path stroke="black" stroke-width="1" fill="white" fill-opacity="0.7" d="M x (y-h1) L x y L (x+33) (y-13) L (x+33) (y-h1-13) Z"/>
```

FIG. 15A

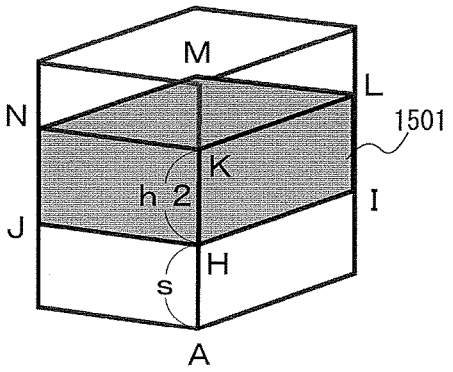

FIG. 15B

1502

| | COORDINATE POSITION |
|---|---|
| A | TRAY POSITION COORDINATES (x, y) |
| H | x , y-s |
| I | x+33 , y-s-13 |
| J | x-35 , y-s-5 |
| K | x, y-s-h2 |
| L | x+33 , y-s-h2-13 |
| M | x-5 , y-s-h2-17 |
| N | x-35 , y-s-h2-5 |

FIG. 15C

1503

```
<path stroke="black" stroke-width="1" fill="gray" fill-opacity="0.7" d="M x (y-s-h2) L (x+33) (y-s-h2-13) L (x-5) (y-s-h2-17) L (x-35) (y-s-h2-5) Z"/>
<path stroke="black" stroke-width="1" fill="gray" fill-opacity="0.7" d="M x (y-s-h2) L (x-35) (y-s-h2-5) L (x-35) (y-s-5) L x (y-s) Z"/>
<path stroke="black" stroke-width="1" fill="gray" fill-opacity="0.7" d="M x (y-s-h2) L x (y-s) L (x+33) (y-s-13) L (x+33) (y-s-h2-13) Z"/>
```

PROCESSED-JOB LIST

| JOB ID | JOB NAME | PROCESSING DAY/TIME | NUMBER OF PAGES | NUMBER OF BUNDLES | USED SHEET |
|---|---|---|---|---|---|
| 00000001 | COPY JOB #1 | 2011/08/13 13:52:21 JST | 5 | 100 | ABC PAPER C081 A4 |
| 00000002 | COPY JOB #2 | 2011/08/13 14:09:02 JST | 20 | 5 | ABC PAPER C082 A4 |
| 00000003 | IMAGE FORMING JOB #1 | 2011/01/21 09:11:43 JST | 100 | 20 | ABC PAPER C081 A4 |
| 00000004 | IMAGE FORMING JOB #2 | 2011/01/21 10:34:28 JST | 150 | 20 | XYZ PAPER/PLAIN PAPER A4 |
| 00000005 | IMAGE FORMING JOB #3 | 2011/02/07 16:46:27 JST | 50 | 100 | XYZ PAPER/PLAIN PAPER A4 |
| | | | | | |

PROCESSED-JOB LIST

| JOB ID | JOB NAME | PROCESSING DAY/TIME | NUMBER OF PAGES | NUMBER OF BUNDLES | USED SHEET |
|---|---|---|---|---|---|
| 00000001 | COPY JOB #1 | 2011/08/13 13:52:21 JST | 5 | 100 | ABC PAPER C081 A4 |
| 00000002 | CIPY JOB #2 | 2011/08/13 14:09:02 JST | 20 | 5 | ABC PAPER C082 A4 |
| 00000003 | IMAGE FORMING JOB #1 | 2011/01/21 09:11:43 JST | 100 | 20 | ABC PAPER C081 A4 |
| 00000004 | IMAGE FORMING JOB #2 | 2011/01/21 10:34:28 JST | 150 | 20 | XYZ PAPER/PLAIN PAPER A4 |
| 00000005 | IMAGE FORMING JOB #3 | 2011/02/07 16:46:27 JST | 50 | 100 | XYZ PAPER/PLAIN PAPER A4 |
| | | | | | |

CONTROL DEVICE FOR CONTROLLING AN IMAGE FORMING SYSTEM

BACKGROUND OF THE INVENTION

Field of the Invention

The present disclosure relates to a control device for controlling an image forming system including an image forming apparatus configured to form an image on a sheet and a plurality of sheet discharge apparatus configured to discharge the sheet having the image formed thereon.

Description of the Related Art

There are known service forms for image formation called print on demand (POD) and production printing. In such service forms, small-lot and high-variety printing orders are received from customers. Then, images are formed using an image forming apparatus operating at high speed to deliver the orders. At this time, images are rapidly formed onto a large amount of sheets (sheet-like media, the same holds true in the following), and the sheets are discharged by a sheet discharge apparatus, for example, a large-capacity stacker.

The large-capacity stacker stacks several thousands of sheets at one time. A plurality of large-capacity stackers may be connected so that, even when one large-capacity stacker is full, image formation can be continued by automatically switching a discharge destination to another large-capacity stacker. In this case, sheets having images formed thereon and corresponding to one image forming job are discharged to a plurality of discharge destinations in a divided manner. In the following description, the "sheet having the image formed thereon" is referred to as "sheet" in some cases.

Meanwhile, an operator performs work of collecting the discharged sheets to proceed to the next step. However, when sheet bundles corresponding to the same image forming job are stacked onto a plurality of discharge destinations in a divided manner, the operator may not know in which order the sheets are required to be collected. As an approach for such an issue, in a technology described in US 2013/0334771, an order of taking out the sheets is displayed on the plurality of discharge destinations, for example, respective sheet discharge trays of the large-capacity stackers, so that the work of taking out the sheets can be performed in this order. In this manner, the sheets having the images formed thereon can be taken out without mistaking the order.

In the technology disclosed in US 2013/0334771, the order of the discharge destinations can be identified, but the order of the sheets corresponding to each image forming job cannot be identified. For example, the technology disclosed in US 2013/0334771 cannot respond to a case in which sheets discharged based on a plurality of image forming jobs are stacked on a sheet bundle being a group of sheets. The same holds true in a case in which sheets discharged based on one image forming job are stacked on a plurality of trays in a divided manner.

As described above, there remains an issue in that it is difficult to collect the sheets in a correct order only with the order of the discharge destinations.

SUMMARY OF THE INVENTION

The present disclosure works towards providing an image forming system allowing sheets stacked on a plurality of portions to be easily taken out in a correct order for each image forming job, and this is achieved by the above embodiments. In an image region of a monitor screen, there is displayed a system configuration image representing an arrangement mode and sheet stacking portions of sheet discharge apparatus with respect to an image forming apparatus. In a list region, a processed-job list in which processed jobs are listed is displayed. When the processed jobs correspond to image forming jobs, sheet bundle images representing the discharged sheet bundles are mapped and displayed at sheet stacking portions of the system configuration image. On the sheet bundle images, order information to order information representing the order of sheet discharge, which are associated with each job, are additionally displayed.

According to an aspect of the present invention, a control device to control a system having an image forming apparatus configured to form an image on a sheet based on an image forming job, and a sheet discharge apparatus having stacking trays on which the sheet having the image formed on the sheet is to be stacked, includes a storage configured to store stacking state information for each stacking tray, a generator configured to generate a system configuration image representing a configuration of the system, and to generate a sheet bundle image representing a sheet bundle stacked on each stacking tray based on the stacking state information stored in the storage, a display controller configured to display, on a display, a screen in which the sheet bundle image is combined at a position of each stacking tray in the system configuration image, and an input portion configured to input designation of an image forming job corresponding to sheets to be taken out, wherein the display controller is configured to display, together with the sheet bundle image, an order of taking out the sheets corresponding to the image forming job designated through the input portion.

Further features of the present disclosure will become apparent from the following description of embodiments (with reference to the attached drawings).

BRIEF DESCRIPTION OF THE DRAWINGS

FIG. 6 is a diagram of apparatus configuration information.

FIG. 14A is an illustration of a sheet bundle image.

FIG. 14B is an illustration of a list.

FIG. 14C is an illustration of a rendering command using SVG.

FIG. 15A is an illustration of a sheet bundle image.

FIG. 15B is an illustration of a list.

FIG. 15C is an illustration of a rendering command using SVG.

DESCRIPTION OF THE EMBODIMENTS

First Embodiment

Figure 1:
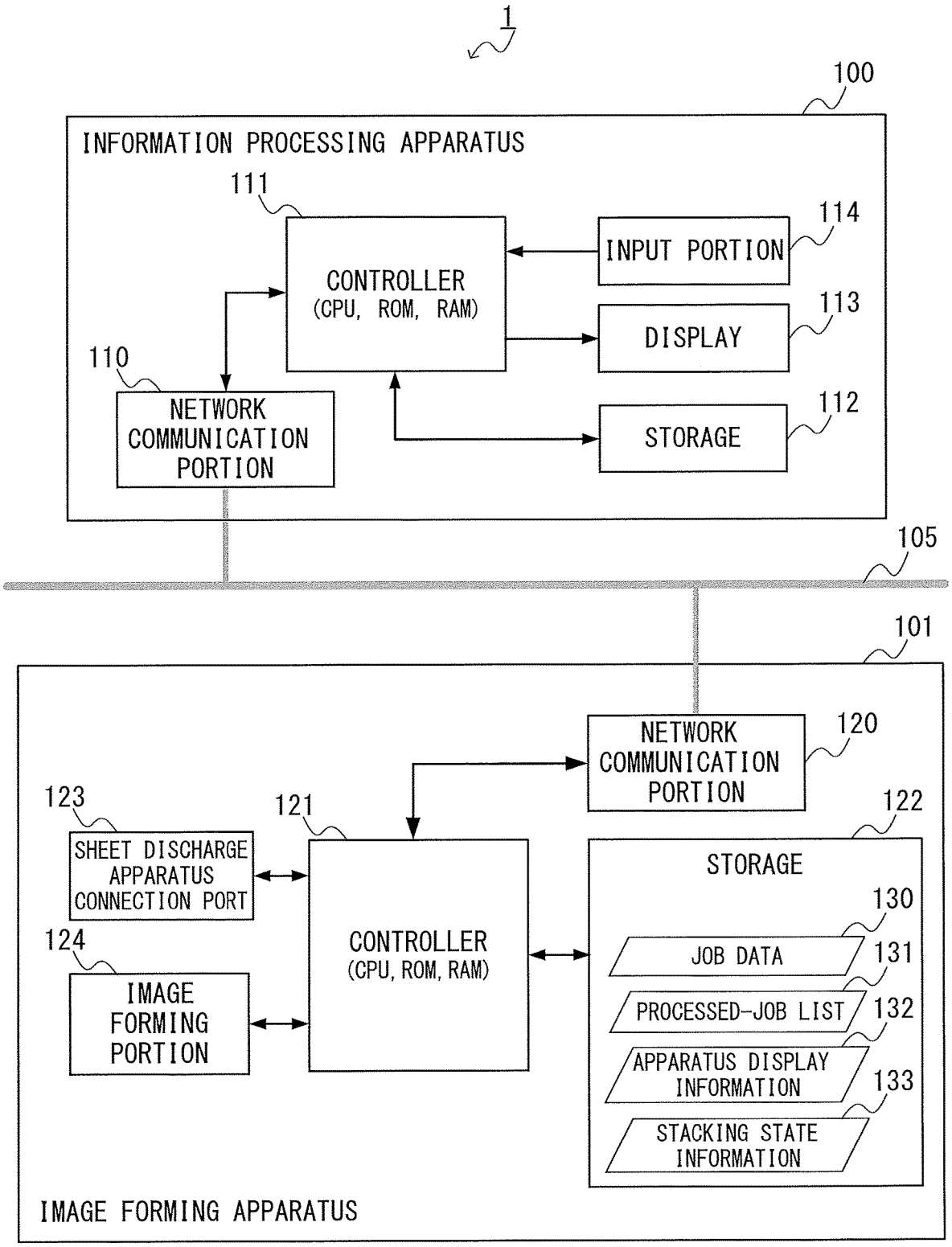
FIG. 1 is a configuration diagram of an image forming system.

FIG. 1 is a diagram for illustrating a schematic configuration example of an image forming system to which the present disclosure is applied. This image forming system 1 includes an information processing apparatus 100 and an image forming apparatus 101, which are connected to a communication network 105. The first embodiment represents an example in which one information processing apparatus 100 and one image forming apparatus 101 are provided, but a plurality of information processing apparatus 100 and a plurality of image forming apparatus 101 may be provided. The communication network 105 is a local area network (LAN). As the communication network 105, a wide area network (WAN), a combination of the LAN and the WAN, or a wired network may be employed instead.

The information processing apparatus 100 includes a network communication portion 110, a controller 111 (control device), a storage 112, a display 113, and an input portion 114. The network communication portion 110 is communication device for controlling the communication performed with the communication network 105. The storage 112 is storage device for storing large-capacity data in a short or long term. The display 113 is display device for performing various types of display for an operator. In the first embodiment, the display 113 displays, for example, a system configuration image and a sheet bundle image to be described later. The input portion 114 receives various instructions from the operator, a range designation, input data, and designation of a processed job. The processed job refers to an image forming job for which image formation to the sheet has been finished as described later. When the display 113 is constructed of a touch panel, various instructions from the operator can also be input from the display 113.

The controller 111 is one type of computer including a central processing unit (CPU), a read only memory (ROM), and a random access memory (RAM). The CPU executes a computer program for terminal control to form various functions for the information processing apparatus 100. This operation is described later. The ROM stores the above-mentioned computer program and the like. The RAM is a work memory for the CPU.

The image forming apparatus 101 includes a network communication portion 120, a controller 121 (control device), a storage 122, a sheet discharge apparatus connection port 123, and an image forming portion 124. The network communication portion 120 is communication device for controlling the communication performed with the communication network 105. The storage 122 is storage device for storing large-capacity data in a short or long term. The sheet discharge apparatus connection port 123 is connection device for connecting the sheet discharge apparatus. The image forming portion 124 is image forming device for forming an image onto a sheet for each input image forming job.

The controller 121 is a computer including a CPU, a ROM, and a RAM, or may be an embedded computer. The CPU executes a computer program for image formation control to form various functions for the image forming apparatus 101 and operate as control device for controlling an operation of each of the functions. This operation is described later. The ROM stores the above-mentioned computer program for image formation control. The RAM is a work memory for the CPU.

The storage 122 of the image forming apparatus 101 stores job data 130, a processed-job list 131, apparatus display information 132, and stacking state information 133. Examples of the job data 130 include image data and instruction data representing the details of the input image forming job, data obtained after execution of the image forming job, and data obtained during the process of execution of the image forming job. The processed-job list 131 is a list storing the image forming jobs executed by the image forming apparatus 101 as the processed jobs. The processed-job list 131 stores, for example, job attributes such as a job ID, a job name, the number of pages, the number of bundles, and a sheet in association with one another.

The apparatus display information 132 is one type of first information representing the entire arrangement mode of image forming device and a plurality of sheet stacking device, and is referred to when a system configuration image to be described later is generated. In this example, the image forming device corresponds to the image forming apparatus 101, and the sheet stacking device corresponds to a sheet discharge apparatus to be described later, and hence information representing the outer appearance, structure, and size of each of the image forming apparatus 101 and the sheet discharge apparatus, and the outer appearance, structure, and size as a whole during connection is referred to as the apparatus display information 132. For example, it is assumed that three sheet discharge apparatus are connected to the image forming apparatus 101 in a daisy-chain configuration. In this case, the apparatus display information 132 represents a mode in which the sheet discharge apparatus adjacent to the image forming apparatus 101 is arranged as the first sheet discharge apparatus, and then the second sheet discharge apparatus and the third sheet discharge apparatus are sequentially arranged. The apparatus display information 132 is determined based on the combination of the connected sheet discharge apparatus. The sheet discharge apparatus is arranged so as to be replaceable with other sheet discharge apparatus. Therefore, the apparatus display information 132 is updated to new information as appropriate.

The stacking state information 133 is one type of second information representing a sheet stacking state of sheets having images formed thereon in each sheet stacking device, and is referred to when a sheet bundle image to be described later is generated. The sheet having an image formed thereon is hereinafter referred to as "sheet" in some cases. Further, a bundle of a plurality of sheets is hereinafter referred to as "sheet bundle" in some cases. The stacking state information 133 includes information representing the shape and the size of the sheet or the sheet bundle, which is required for generating the sheet bundle image to be described later. This information is updated in real time every time a detection result of a stacking state detected by detection device to be described later is acquired. The "stacking state" herein refers to presence or absence of a sheet at a sheet stacking portion (including the change in portion at which the sheets are stacked), and the transition of the outer shape and the size of the sheet and the sheet stacking height, that is, refers to all the changes in sheet state until the sheets are collected from the sheet stacking portion.

Next, the sheet discharge apparatus to be connected to the sheet discharge apparatus connection port 123 of the image forming apparatus 101 are described. The sheet discharge apparatus refers to a large-capacity stacker and a finisher, and are apparatus capable of being freely combined or replaced afterwards. Those sheet discharge apparatus operate as sheet stacking device capable of stacking and collecting the sheets for each image forming job. That is, each sheet discharge apparatus stacks sheets corresponding to a processed job onto the sheet stacking portion to achieve a sheet bundle of each image forming job.

Figure 2:
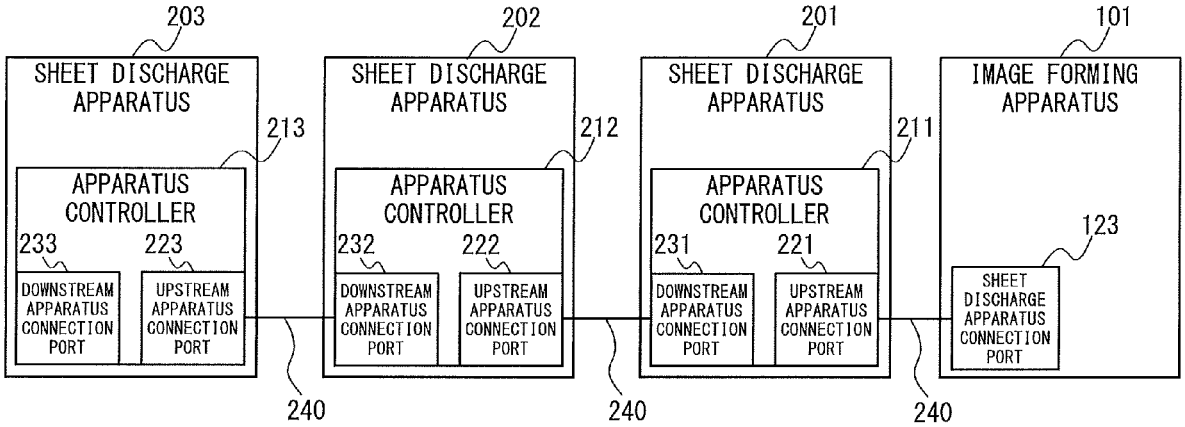
FIG. 2 is a schematic diagram for illustrating a state in which sheet discharge apparatus are connected to an image forming apparatus.

FIG. 2 is a schematic diagram for illustrating a connection example in a case in which three sheet discharge apparatus 201 to 203 are connected to the sheet discharge apparatus connection port 123 in a daisy-chain configuration. The sheet discharge apparatus 201 to 203 include apparatus controllers 211, 212, and 213, respectively, for controlling the operation of each own apparatus. The apparatus controllers 211, 212, and 213 include upstream apparatus connection ports 221, 222, and 223 and downstream apparatus connection ports 231, 232, and 233, respectively. Each of the upstream apparatus connection ports 221, 222, and 223 is a port for connecting to an apparatus on the upstream of the own apparatus via a communication cable 240. Each of the downstream apparatus connection ports 231, 232, and 233 is a port for connecting to an apparatus on the downstream of the own apparatus via the communication cable 240. In this manner, the image forming apparatus 101 and the three sheet discharge apparatus 201, 202, and 203 can communicate with each other. The third sheet discharge apparatus 203 may be omitted, or another apparatus that can communicate with the image forming apparatus 101 may be connected on the downstream of the third sheet discharge apparatus 203.

Figure 3:
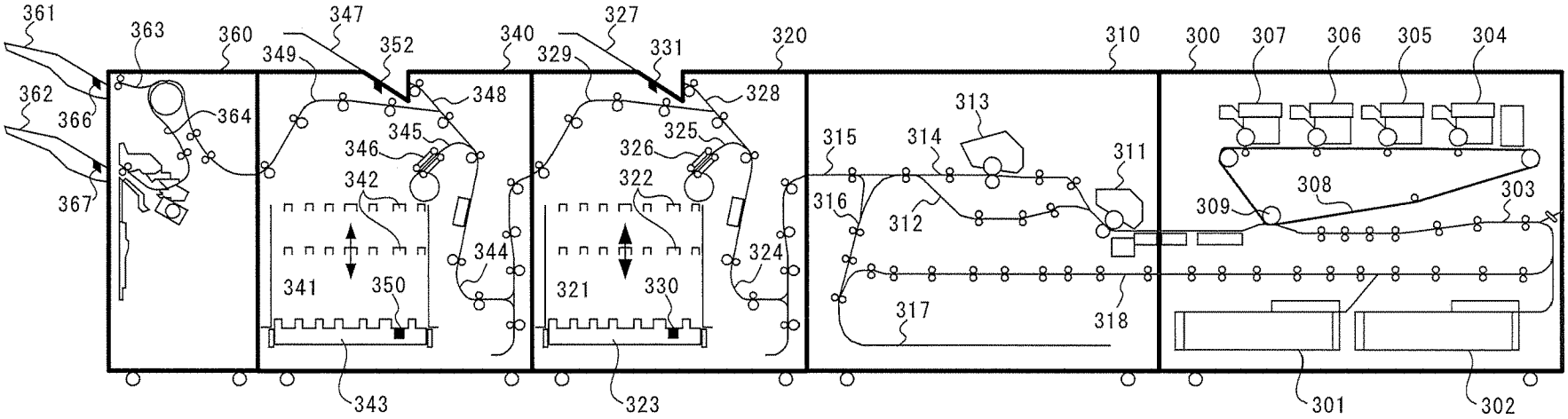
FIG. 3 is a sectional view for illustrating conveyance mechanisms of the image forming system.

Each of the image forming apparatus 101 and the sheet discharge apparatus 201, 202, and 203 includes a sheet conveyance mechanism as a mechanical element. FIG. 3 is an explanatory view for illustrating those conveyance mechanisms. In FIG. 3, an image forming unit 300 is a unit configured to form an image to be transferred onto a sheet, and corresponds to the image forming portion 124 in FIG. 1. An image fixing unit 310 is a unit configured to fix the transferred image. Two large-capacity stackers 320 and 340 and one finisher 360 are connected to the image fixing unit 310 in a daisy-chain configuration.

In the image forming unit 300, each of sheet feeding decks 301 and 302 separates one uppermost sheet among the received sheets to convey the sheet to a sheet conveyance path 303. Development stations 304 to 307 use toner having colors of yellow (Y), magenta (M), cyan (C), and black (K) to cause adhesion of toner images. The adhering toner images are primarily transferred onto an intermediate transfer belt 308. The intermediate transfer belt 308 rotates, for example, clockwise to convey the sheet to a secondary transfer position 309. At this time, the toner images are transferred onto the sheet conveyed through the sheet conveyance path 303. The sheet having the toner images transferred thereon is conveyed to the image fixing unit 310.

In the image fixing unit 310, a fixing unit 311 melts and pressurizes the toner images to fix the toner images onto the sheet. The sheet that has passed through the fixing unit 311 is conveyed from a sheet conveyance path 312 to a sheet conveyance path 315. Additional heating and pressurization may be required depending on the sheet type. In this case, after the sheet passes through the fixing unit 311, the sheet is conveyed to a second fixing unit 313 using a sheet conveyance path in the stage subsequent to the fixing unit 311. The sheet subjected to additional heating and pressurization is conveyed to a sheet conveyance path 314. A reversing portion 316 reverses the conveyed sheet by a switch-back method. When an image is formed on one side of the sheet, the reversed sheet, that is, the sheet having an image formed thereon, is conveyed to the sheet conveyance path 315. When images are formed on both sides of the sheet, the sheet is conveyed to a duplex reverse path 317, and is reversed to be conveyed to a duplex conveyance path 318. In this manner, an image is formed on the second side at the secondary transfer position 309, and the sheet is conveyed to the sheet conveyance path 315. The sheet that has passed through the sheet conveyance path 315 passes through a sheet conveyance path 324 to be input to the large-capacity stacker 320.

The large-capacity stacker 320 includes a stacking portion 321 including a lift tray 322 and an ejection tray 323, which are each configured to stack sheets. Those trays are controlled by the apparatus controller 211 illustrated in FIG. 2. The lift tray 322 is positioned at a sheet stacking portion having a predetermined height under a state in which no sheets are stacked, and is lowered when the stacking proceeds. The ejection tray 323 is a tray for re-stacking the sheets at a time point at which the lift tray 322 is lowered to a re-stacking position, to thereby eject the sheets to the outside of the apparatus. The lift tray 322 and the ejection tray 323 are formed so that their bars for supporting the sheets are present at alternate positions. Therefore, the sheets on the lift tray 322 can be re-stacked onto the ejection tray 323 without issue. The sheet passes through the sheet conveyance path 324 and a sheet conveyance path 325 to be conveyed to a sheet discharge unit 326. The sheet discharge unit 326 includes a lower rotary member and an upper rotary member that are configured to nip the sheet, and to discharge the sheet in a flipped manner to the lift tray 322. The action of "discharging the sheet in a flipped manner" refers to an action of discharging the sheet with the front and back sides being reversed so that one of both surfaces of the sheet on a side in contact with the lower rotary member of the sheet discharge unit 326 is turned to become an upper surface on the lift tray 322.

The lift tray 322 is controlled to be lowered by an amount of a height of the stacked sheets as the stacking of the sheets proceeds so that an upper end of the stacked sheets is always at a predetermined height. When the lift tray 322 is in a fully-stacked state, the lift tray 322 is lowered to the position of the ejection tray 323. The "fully-stacked state" refers to a state in which the sheets reach a maximum stackable amount of the lift tray 322 and no more sheets can be stacked on the lift tray 322. Then, at a time point at which the lift tray 322 reaches the re-stacking position that is lower than the ejection tray 323, the sheets are re-stacked onto the ejection tray 323. After that, the ejection tray 323 is carried to the outside of the apparatus. In this manner, the sheets are removable. This operation is called "ejecting operation".

The large-capacity stacker 320 further includes a top tray 327. The top tray 327 is one sheet stacking portion mainly used for outputting a sample of the sheets to be stacked on the stacking portion 321. During discharge to the stacking portion 321, one sheet (or one bundle) is output to the top tray 327 as a sample. In this manner, the quality of the image formation can be checked without taking out the sheets stacked in the stacking portion 321. When a sheet is output to the top tray 327, the sheet passes through the sheet conveyance path 324 and a sheet conveyance path 328 to be conveyed to the top tray 327. When a sheet is conveyed to an apparatus on the downstream of the large-capacity stacker 320, the sheet is conveyed through a sheet conveyance path 329.

The ejection tray 323 and the top tray 327 include sheet presence/absence detection sensors 330 and 331, respectively. The sheet presence/absence detection sensors 330 and 331 operate as one type of detection device for detecting the change in stacking state of the sheets on the tray at every predetermined timing. The controller 121 acquires detection information detected by the sheet presence/absence detection sensors 330 and 331 in time series, and updates the stacking state information 133 in the storage 122 based on the acquired detection information. The large-capacity stacker 340 has the same configuration as that of the large-capacity stacker 320. That is, the stacking portion 321 (lift tray 322 and ejection tray 323) of the large-capacity stacker 320 corresponds to a stacking portion 341 (lift tray 342 and ejection tray 343) of the large-capacity stacker 340. Similarly, the sheet conveyance paths 324, 325, 328, and 329 and the sheet discharge unit 326 of the large-capacity stacker 320 correspond to sheet conveyance paths 344, 345, 348, and 349 and a sheet discharge unit 346 of the large-capacity stacker 340, respectively. Further, the top tray 327 and the sheet presence/absence detection sensors 330 and 331 of the large-capacity stacker 320 correspond to a top tray 347 and sheet presence/absence detection sensors 350 and 352 of the large-capacity stacker 340, respectively. Those components are controlled by the apparatus controller 212.

The finisher 360 subjects the conveyed sheet to predetermined post-processing under the control of the apparatus controller 213 illustrated in FIG. 2 based on the function designated by the operator. As an example of the post-processing, in this example, the sheet is subjected to stapling (one-portion or two-portion binding) and punching (two or three holes). The finisher 360 includes two sheet discharge trays 361 and 362 each serving as a sheet stacking portion. To the sheet discharge tray 361, a sheet not to be subjected to post-processing, for example, stapling, is discharged through a sheet conveyance path 363. To the sheet discharge tray 362, a sheet subjected to a finishing function designated by the operator is discharged through a sheet conveyance path 364.

Each of the sheet discharge trays 361 and 362 is configured to be freely raised or lowered. It is also possible to perform such an operation that the sheet discharge tray 361 is lowered so that a plurality of sheets subjected to post-processing are stacked onto the sheet discharge tray 361. The sheet discharge trays 361 and 362 include sheet presence/absence detection sensors 366 and 367, respectively, which are each configured to detect the stacking state of the sheets on the tray. The sheet presence/absence detection sensors 366 and 367 also operate as one type of detection device for detecting the change in stacking state of sheets on the tray at every predetermined timing. The detection results (detection information) are transmitted to the image forming apparatus 101 in time series by the apparatus controllers included in the large-capacity stackers 320 and 340.

Next, description is given of the sheet stacking state in the large-capacity stacker 320 with reference to FIG. 4A to FIG. 4G. In each drawing, a right side as viewed from an observer corresponds to a sectional view in which the mechanical elements of the large-capacity stacker 320 are viewed from the front side, and a left side as viewed from the observer corresponds to a sectional view in which the mechanical elements of the large-capacity stacker 320 are viewed from the left lateral side. The large-capacity stacker 340 has a similar configuration, and hence the large-capacity stacker 320 is described as a representative stacker.

Figure 4A:
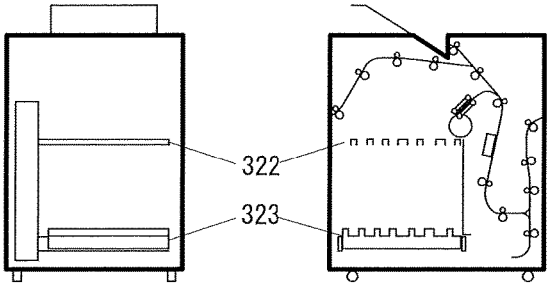
FIG. 4A, FIG. 4B, FIG. 4C, FIG. 4D, FIG. 4E, FIG. 4F, and FIG. 4G are schematic views for illustrating a process of an ejecting operation.
Figure 4B:
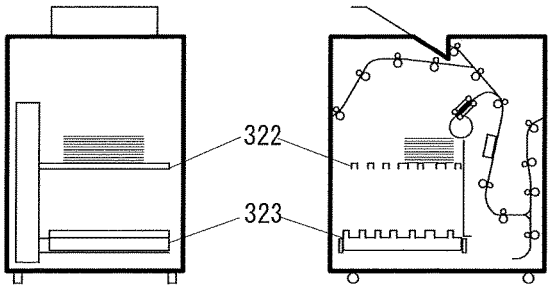
Figure 4C:
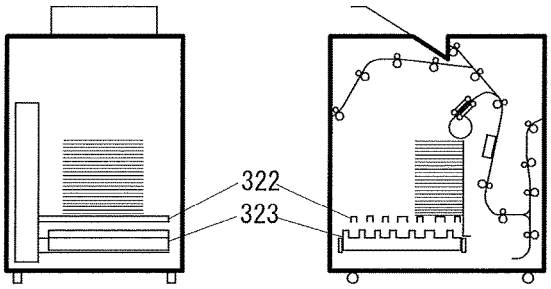
Figure 4D:
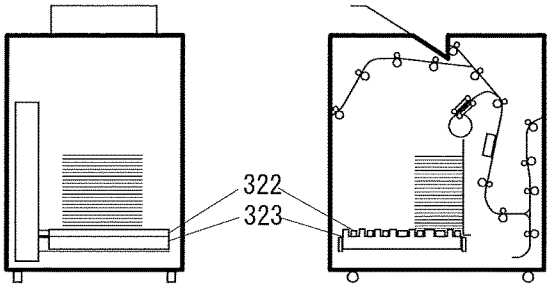

FIG. 4A is an illustration of a state in which no sheets are stacked on the large-capacity stacker 320. The lift tray 322 is raised and stopped at a predetermined height, that is, at a position of a sheet discharge port for discharging the sheets to the stacking portion 321. The ejection tray 323 is accommodated in the apparatus. FIG. 4B is an illustration of a state during an image forming operation. As the stacking of the sheet proceeds, the apparatus controller gradually lowers the lift tray 322 so that the height of the uppermost surface of the stacked sheets matches the position of the sheet discharge port of the stacking portion 321. FIG. 4C is an illustration of a state in which a fully-stacked state of the lift tray 322 is detected. When the lift tray 322 is in the fully-stacked state, stacking onto the lift tray 322 cannot be continued any more. Therefore, the apparatus controller starts control of re-stacking the stacked sheets onto the ejection tray 323. FIG. 4D is an illustration of a state in which the lift tray 322 is lowered to the re-stacking position of the ejection tray 323 and the sheets are re-stacked onto the ejection tray 323. Even when the lift tray 322 is lowered to the same height as that of the ejection tray 323, the bars for supporting the sheets are located at alternate positions, and hence the bars do not interfere with each other. At a time point at which the lift tray 322 reaches the re-stacking position that is lower than the ejection tray 323, there is obtained a state in which the sheets stacked on the lift tray 322 are re-stacked onto the ejection tray 323.

Figure 4E:
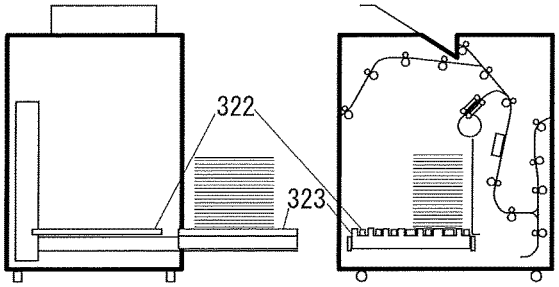
Figure 4F:
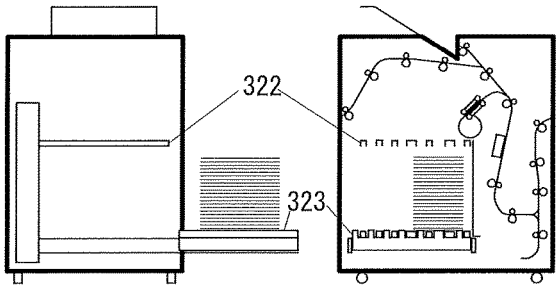
Figure 4G:
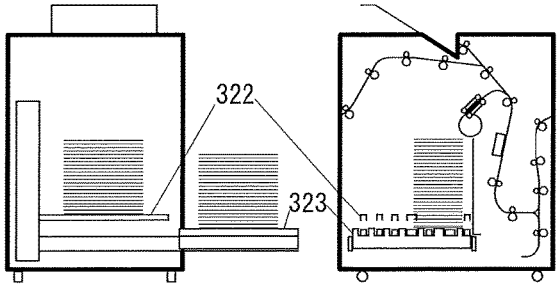

FIG. 4E is an illustration of a state in which the ejection tray 323 having the sheets stacked thereon is ejected to the outside of the apparatus. When the ejection tray 323 is ejected as described above, the stacked sheets become collectable. FIG. 4F is an illustration of a state in which, under a state in which the ejection tray 323 is ejected, the lift tray 322 is raised again to the position at which the subsequent sheets are stacked thereon. In this manner, sheets can be stacked on the lift tray 322. FIG. 4G is an illustration of a state in which, after the image formation is continued under a state in which the ejection tray 323 is ejected, the fully-stacked state of the lift tray 322 is detected. In this state, the ejection tray 323 is ejected, and hence the sheets stacked on the lift tray 322 cannot be re-stacked onto the ejection tray 323. The sheets stacked on the ejection tray 323 are required to be collected to continue the stacking in the large-capacity stacker 320.

Figure 5A:
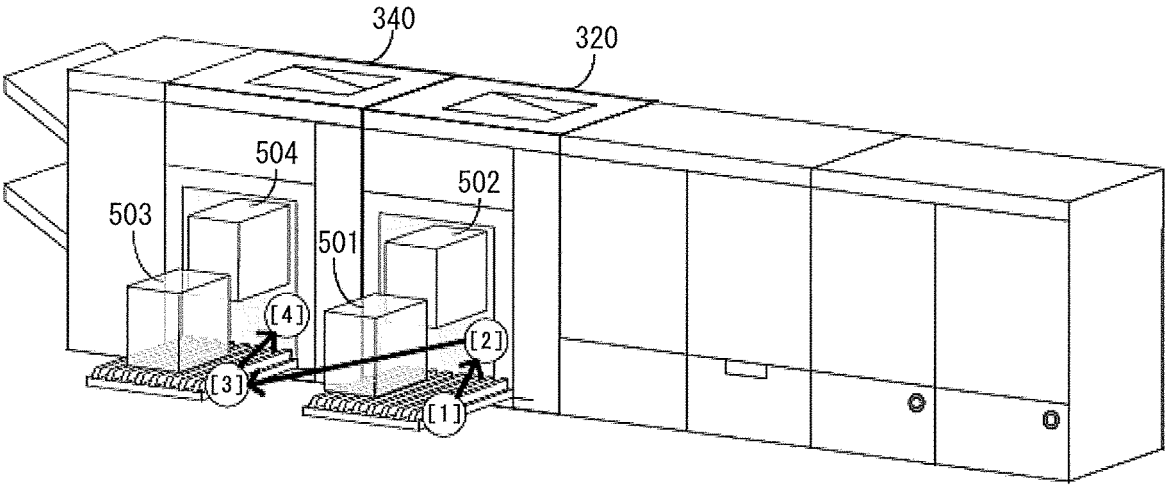
FIG. 5A and FIG. 5B are explanatory views for illustrating modes of stacking sheet bundles onto respective trays.
Figure 5B:
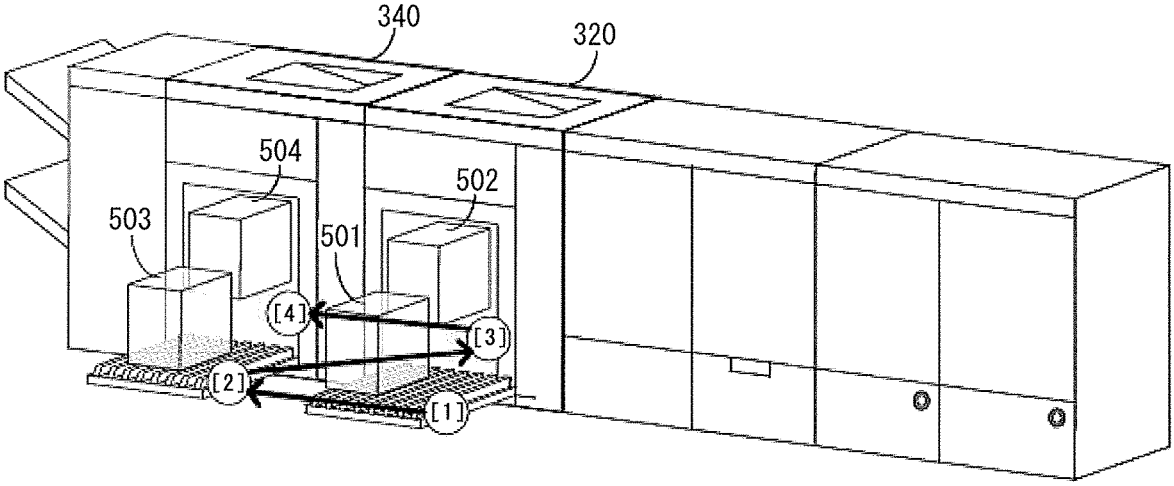

FIG. 5A and FIG. 5B are explanatory views for illustrating an order of stacking the sheet bundles onto the respective trays of the large-capacity stackers. Description is given of an example in which, similarly to FIG. 3, two large-capacity stackers 320 and 340 are connected. For example, as described with reference to FIG. 4A to FIG. 4G, the large-capacity stacker 320 has a configuration in which the sheet bundles can be stacked onto the lift tray 322 and the ejection tray 323. The same holds true in the large-capacity stacker 340. Therefore, in the configuration in which two large-capacity stackers 320 and 340 are connected, the sheet bundles can be stacked onto a total of four trays. In the image forming system, two types of stacking modes are prepared as the order of stacking the sheets onto the four trays.

FIG. 5A is an illustration of a first stacking mode in which, after the tray of one large-capacity stacker is in a fully-stacked state, the sheets are output to the next large-capacity stacker. In this first stacking mode, output of the sheets to the large-capacity stacker 320 is started, and after both of the lift tray and the ejection tray of the large-capacity stacker 320 are in the fully-stacked state, the sheets are output to the large-capacity stacker 340. Pieces of order information on discharge of sheets 501 to 504 to the trays are indicated by Numerals [1] to [4]. The first stacking mode has a benefit in that the operator can more easily understand the stacking state because the sheets are stacked onto the next large-capacity stacker 340 after the large-capacity stacker 320 is in the fully-stacked state.

FIG. 5B is an illustration of a second stacking mode in which, while the lift tray of one large-capacity stacker is in the fully-stacked state and the ejecting operation is performed, the stacking to the other large-capacity stacker is started. In the second stacking mode, the large-capacity stackers are alternately used. Therefore, when the stacking is started from the large-capacity stacker 320, the sheets are stacked in the order of Numerals [1] to [4] of FIG. 5B. This second stacking mode is more beneficial in performance as compared to the first stacking mode because the sheets can be also stacked while the ejecting operation is performed. In the image forming system, in addition to the above-mentioned two-type stacking modes, a large-capacity stacker for stacking sheets can also be designated.

FIG. 6 is a diagram of a monitor screen to be displayed on the display 113 of the information processing apparatus 100 when the image forming job is executed in the image forming apparatus 101. The display content of this monitor screen is generated by the controller 111 based on the apparatus display information 132 received from the image forming apparatus 101. Alternatively, the controller 121 of the image forming apparatus 101 may generate the display content, and the information processing apparatus 100 may acquire the display content. The content of the apparatus display information 132 differs depending on the combination of the sheet discharge apparatus. In the first embodiment, for the sake of convenience of description, it is assumed that the apparatus display information 132 corresponding to all combinations of mountable sheet discharge apparatus is stored in advance. As an example, description is given of an example of the apparatus display information 132 corresponding to the arrangement mode exemplified in FIG. 3. A schematic diagram is used in FIG. 6, but the actual apparatus display information 132 is stored in a form of an extensible markup language (XML) or comma-separated values (CSV), for example.

The upper stage of FIG. 6 represents a system configuration image 601 that visualizes the entire arrangement mode by expressing the entire arrangement mode in, for example, a bitmap format, and the lower stage of FIG. 6 represents a table in which information on position of the sheet discharge tray included in each sheet discharge apparatus is stored. The system configuration image 601 can be displayed as a two-dimensional image or a three-dimensional image, but is displayed as a three-dimensional image in this case. A sheet or a sheet bundle is not drawn in the system configuration image 601 illustrated at the upper stage of FIG. 6, but when a sheet is conveyed, a structure image of the sheet discharge tray at the stacking portion for the sheet is also displayed. For example, there is displayed a system configuration image including a structure image representing a lift tray and an ejection tray that are displaced in the above-mentioned large-capacity stackers 320 and 340. In the example illustrated in FIG. 3, each of the large-capacity stackers 320 and 340 includes three sheet discharge trays (top tray, lift tray, and ejection tray), and the finisher 360 includes two sheet discharge trays (upper tray and lower tray). Therefore, in such an arrangement mode, a total of eight sheet discharge trays are usable. In the system configuration image 601 at the upper stage of FIG. 6, an actual arrangement mode and structure images of those sheet discharge apparatus and sheet discharge trays are displayed. Therefore, the operator can intuitively recognize which sheet discharge tray the sheets are stacked on and whether the sheets are collectable.

In the table shown at the lower stage of FIG. 6, each of records of trays #1 to #8 corresponds to a sheet discharge apparatus 621 to which each tray is installed, a tray type 622, and tray position coordinates 623. That is, "tray #1" is the top tray of the large-capacity stacker 320. In this case, the top tray of the large-capacity stacker 320 is provided at tray position coordinates (396, 102) with reference to the system configuration image 601. The tray position coordinates are offset values (pixel numbers) in a right direction and a lower direction with the upper left of the system configuration image 601 serving as an origin. Other trays #2 to #8 have similar content.

Figure 7:
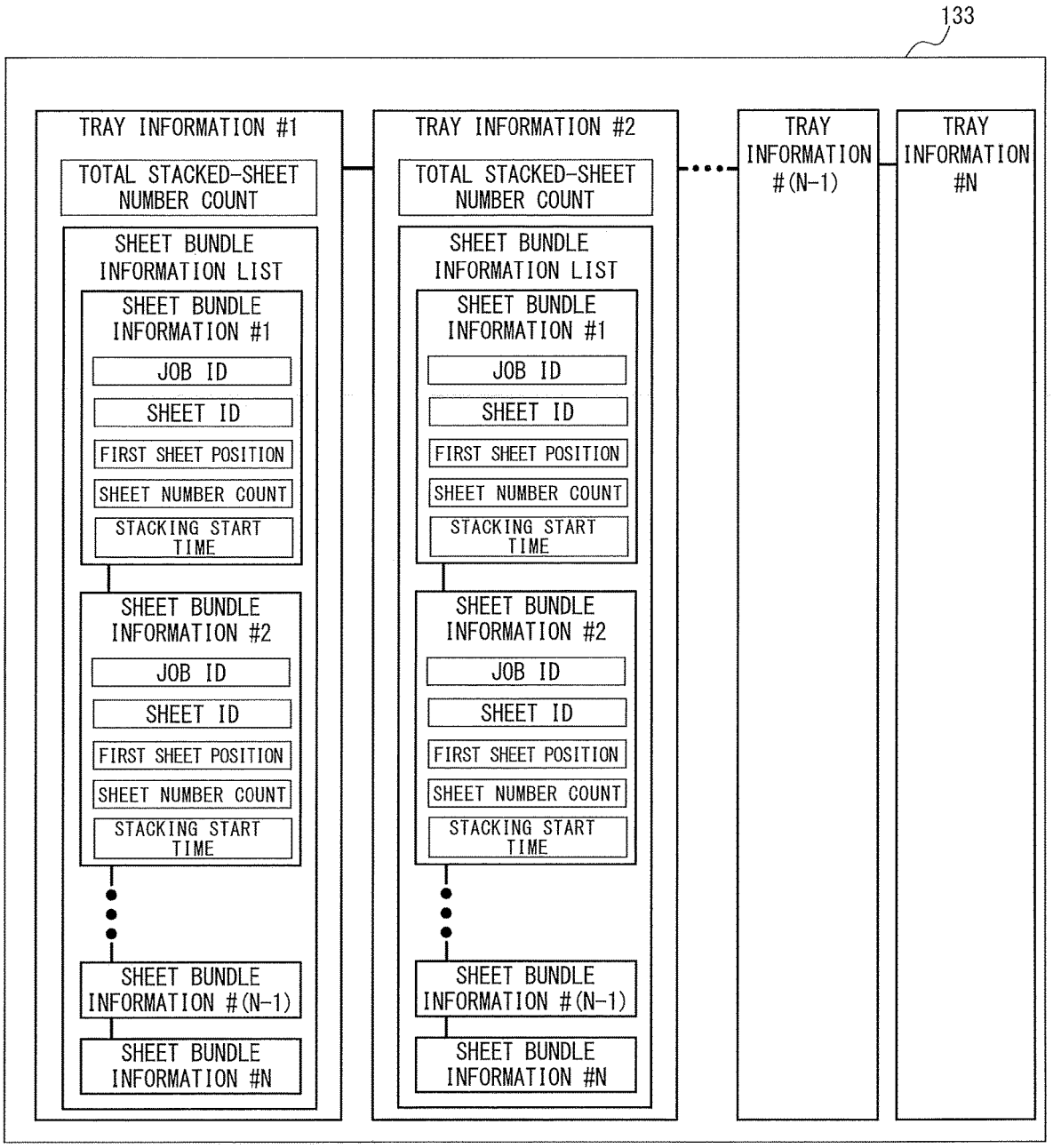
FIG. 7 is a diagram of stacking state information.

FIG. 7 is a diagram of the stacking state information 133. The stacking state information 133 is stored in the storage 122 by the controller 121, and is updated at a timing at which the detection result of the stacking state in each sheet discharge tray is acquired, for example. Further, the stacking state information 133 can be referred to by the controller 121 as appropriate. The stacking state information 133 has a list-type data structure. That is, tray information representing the stacking state of the usable sheet discharge tray for each tray is represented as tray information #1 to tray information #N. In the relationship with the table shown at the lower stage of FIG. 6, the detection result of the stacking state in the tray #1 corresponds to the tray information #1. The same applies to the tray information #2, the tray information #(N−1), and the tray information #N. N is a natural number, and N is 8 in the case of the arrangement mode illustrated in FIG. 3.

In FIG. 7, the tray information #1 to the tray information #8 are in a data format having a total stacked-sheet number count and a sheet bundle information list as member variables. The total stacked-sheet number count is a variable for counting a total number of sheets stacked on the sheet discharge tray. In the sheet bundle information list, pieces of sheet bundle information being the information on attributes of each sheet bundle are arranged in a list in the stacking order of the sheets. When no sheets are stacked on any sheet discharge tray, the sheet bundle information list is an empty list. Each piece of sheet bundle information has, as member variables, a job ID, a sheet ID, a first sheet position, a sheet number count, and a stacking start time. The job ID is a variable representing an ID of an image forming job corresponding to the sheet bundle. Each image forming job is allocated with a unique ID by the image forming apparatus 101, and the ID is stored in the member variable. The sheet ID is a variable representing an ID of the sheet corresponding to the sheet bundle. The sheet is defined based on characteristics such as a size, a basis weight, and states of the front and back surfaces, and a sheet ID allocated for identifying the sheet is recorded in the member variable. The first sheet position is a variable representing what number the first sheet of the sheet bundle corresponds to when counted from the first sheet stacked on the sheet discharge tray. The sheet number count is a variable for counting the total number of sheets of the sheet bundle. The stacking start time is a variable for storing the time at which the first sheet of the sheet bundle is discharged.

Figure 8:
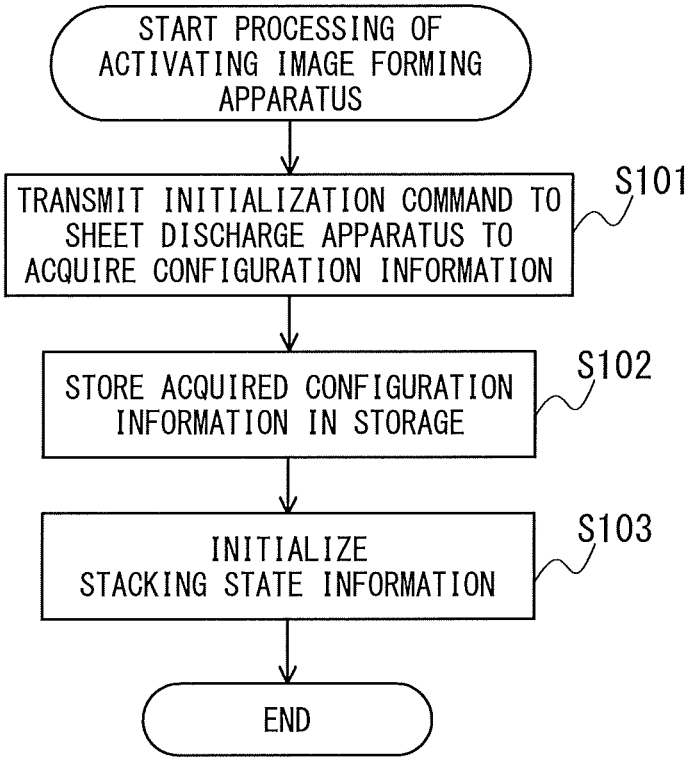
FIG. 8 is a control flow for illustrating an operation procedure performed when the image forming apparatus is activated.

Next, an operation example of the image forming system in the first embodiment is described. First, the operation performed when the image forming apparatus 101 is activated is described with reference to FIG. 8. FIG. 8 is a control flow performed when the image forming apparatus 101 is activated. This control flow is executed by the controller 121 integrally controlling the respective portions of the apparatus. When the image forming apparatus 101 is activated, the controller 121 transmits an initialization command to all of the connected sheet discharge apparatus (Step S101). The initialization command is transmitted to each sheet discharge apparatus via the communication cable. After each sheet discharge apparatus receives the initialization command, the sheet discharge apparatus transmits back to the image forming apparatus 101 the sheet discharge apparatus ID for identifying the type of the own apparatus.

The controller 121 stores the received system configuration information in the storage 122 (Step S102). The system configuration information should include the sheet discharge apparatus ID. With the acquired system configuration information, for example, the configuration of the sheet discharge apparatus that is currently connected can be recognized. The controller 121 identifies the apparatus display information 132 corresponding to the configuration of the currently-connected sheet discharge apparatus based on the system configuration information or the stored sheet discharge apparatus ID from the apparatus display information stored in advance in accordance with the combination of the sheet discharge apparatus. For example, in the apparatus configuration illustrated in FIG. 3, the apparatus display information 132 corresponding to the configuration in which two large-capacity stackers and one finisher are connected is identified.

After the apparatus display information 132 is identified, the controller 121 initializes the stacking state information 133 (Step S103). That is, the stacking state information 133 is newly generated based on the sheet discharge apparatus ID stored in Step S102. Sheets are not stacked yet on any sheet discharge tray immediately after the image forming apparatus 101 is activated. Therefore, in each piece of tray information of the stacking state information 133, the total stacked-sheet number count is 0, and the sheet bundle information list is an empty list.

Figure 9:
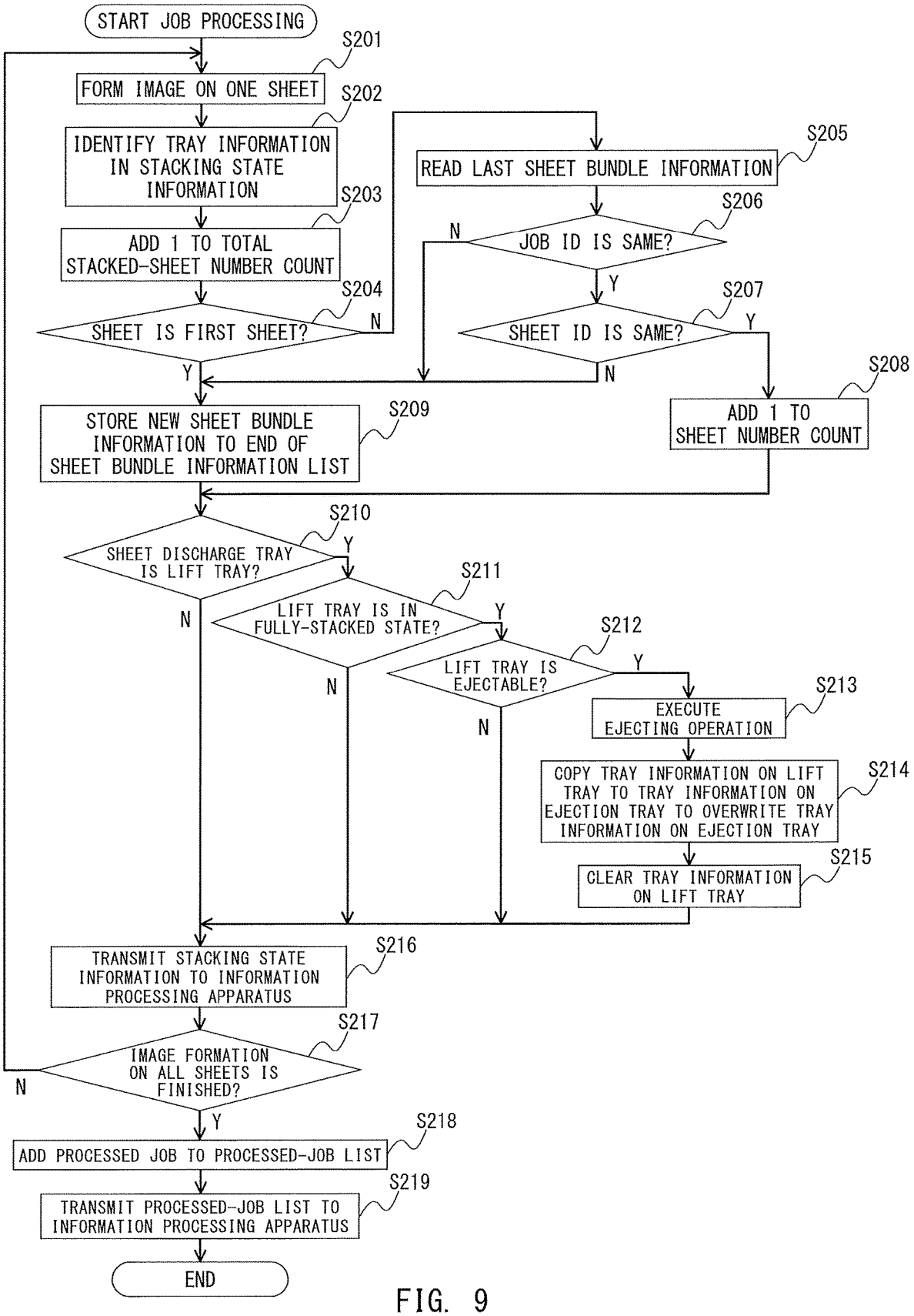
FIG. 9 is a control flow performed when an image forming job is executed in the image forming apparatus.

Next, with reference to FIG. 9, description is given of an operation example at the time when the image forming job is processed in the image forming apparatus 101. It is assumed that the image forming job is received from, for example, the information processing apparatus 100. The image forming job includes designation of tray information on the sheet stacking portion, that is, the sheet discharge apparatus for stacking the sheets having the images formed thereon. In the following description, for the sake of convenience, it is assumed that the tray information on the large-capacity stacker 320 is designated. FIG. 9 is a control flow of the image forming apparatus 101 at this time. This control flow is also executed by the controller 121 integrally controlling the respective portions of the apparatus.

In the image forming apparatus 101, image formation of one sheet is performed in the order of pages in accordance with the image forming job (Step S201). After the image formation, the conveyance of the sheet toward the large-capacity stacker 320 designated by the image forming job is started. At this time, the controller 121 identifies the tray information on the designated large-capacity stacker 320 (Step S202). The tray information can be identified by referring to the apparatus display information 132 determined based on the apparatus configuration of the sheet discharge apparatus. For example, tray #1 of the tray information of the table at the lower stage of FIG. 6 is referred to. Tray #1 corresponds to the top tray of the large-capacity stacker 320. Similarly, tray #2 corresponds to the lift tray of the large-capacity stacker 320. When tray #2 is identified here, the controller 121 refers to the record of tray #2 as the tray information.

The controller 121 adds 1 to the total stacked-sheet number count of the identified tray information (Step S203). The controller 121 further determines whether or not the discharged sheet is the first sheet in the sheet discharge tray based on the value of the total stacked-sheet number count (Step S204). When the sheet is not the first sheet (Step S204: N), the controller 121 refers to the tray information to read last sheet bundle information in the sheet bundle information list (Step S205). Then, the controller 121 determines whether or not the job ID of the job for which the image formation is performed is the same as the job ID in the sheet bundle information read in Step S205 (Step S206). When the job 1D is the same (Step S206: Y), the controller 121 determines whether or not the sheet ID of the sheet printed in Step S201 is the same as the sheet ID in the sheet bundle information read in Step S205 (Step S207). When the sheet ID is the same (Step S207: Y), the controller 121 adds 1 to the sheet number count of the last sheet bundle information in the tray information (Step S208), and the processing proceeds to Step S210.

When the sheet is the first sheet in Step S204 (Step S204: Y), when the job ID differs in Step S206 (Step S206: N), and when the sheet ID differs in Step S207 (Step S207: N), the controller 121 executes the processing of Step S209. That is, new sheet bundle information is generated at the end of the sheet bundle information list in the tray information. The member variables of the generated new sheet bundle information are as follows. First, the job ID is the job ID of the job for which the printing is performed. The sheet ID is a sheet ID corresponding to the sheet printed in Step S201. The total stacked-sheet number count is input as the first sheet position. The sheet number count is 1. The time at which the sheet bundle information is generated is input as the stacking start time.

Next, the controller 121 determines whether or not the sheet discharge tray designated in Step S201 is the lift tray of the large-capacity stacker 320 (Step S210). When the sheet discharge tray is the lift tray (Step S210: Y), the controller 121 determines whether or not the lift tray is in the fully-stacked state after sheets are discharged in Step S201 (Step S211). When the lift tray is in the fully-stacked state (Step S211: Y), the controller 121 determines whether or not the lift tray in the fully-stacked state in Step S211 is ejectable (Step S212). Whether the lift tray is ejectable is determined based on whether or not the sheet bundles are stacked on the ejection tray of the same large-capacity stacker. When the sheet bundles are stacked on the ejection tray, that is, when the sheet presence/absence detection sensor 330 or the like detects that the sheet bundles are stacked, the controller 121 determines that the lift tray is not ejectable. Otherwise, the controller 121 determines that the lift tray is ejectable. When the lift tray is ejectable (Step S212: Y), the controller 121 re-stacks the sheet bundles stacked on the lift tray detected to be in the fully-stacked state in Step S211 onto the ejection tray, and executes the ejecting operation (Step S213). After that, the controller 121 copies, in the stacking state information 133, the tray information on the lift tray for which the ejecting operation of the large-capacity stacker 320 is executed in Step S213, to the tray information on the same large-capacity stacker to overwrite the tray information on the same large-capacity stacker (Step S214). Further, the controller 121 clears, in the stacking state information 133, the tray information on the lift tray for which the ejecting operation is executed in Step S213 (Step S215). In this case, clearing the tray information refers to obtaining an empty sheet bundle information list by setting the total stacked-sheet number count in the tray information to 0.

In Step S210, when the sheet discharge tray is not the lift tray (Step S210: N), when the lift tray is not in the fully-stacked state (Step S211: N), and when the lift tray is not ejectable (Step S212: N), the controller 121 transmits the stacking state information 133 to the information processing apparatus 100 (Step S216). The same is applied after the tray information on the lift tray is cleared (Step S215). After that, the controller 121 determines whether or not the image formation of all of the sheets by the image forming job is finished (Step S217). When the image formation is not finished yet (Step S217: N), the processing returns to Step S201. When image formation of all of the sheets is finished (Step S217: Y), the controller 121 lists (adds) the image forming job for which the processing has been finished to the processed-job list 131 as the processed job (Step S218). Then, the controller 121 transmits the processed-job list 131 that has been updated based on the addition to the information processing apparatus 100 (Step S219), and the series of processing is ended.

Figure 10:
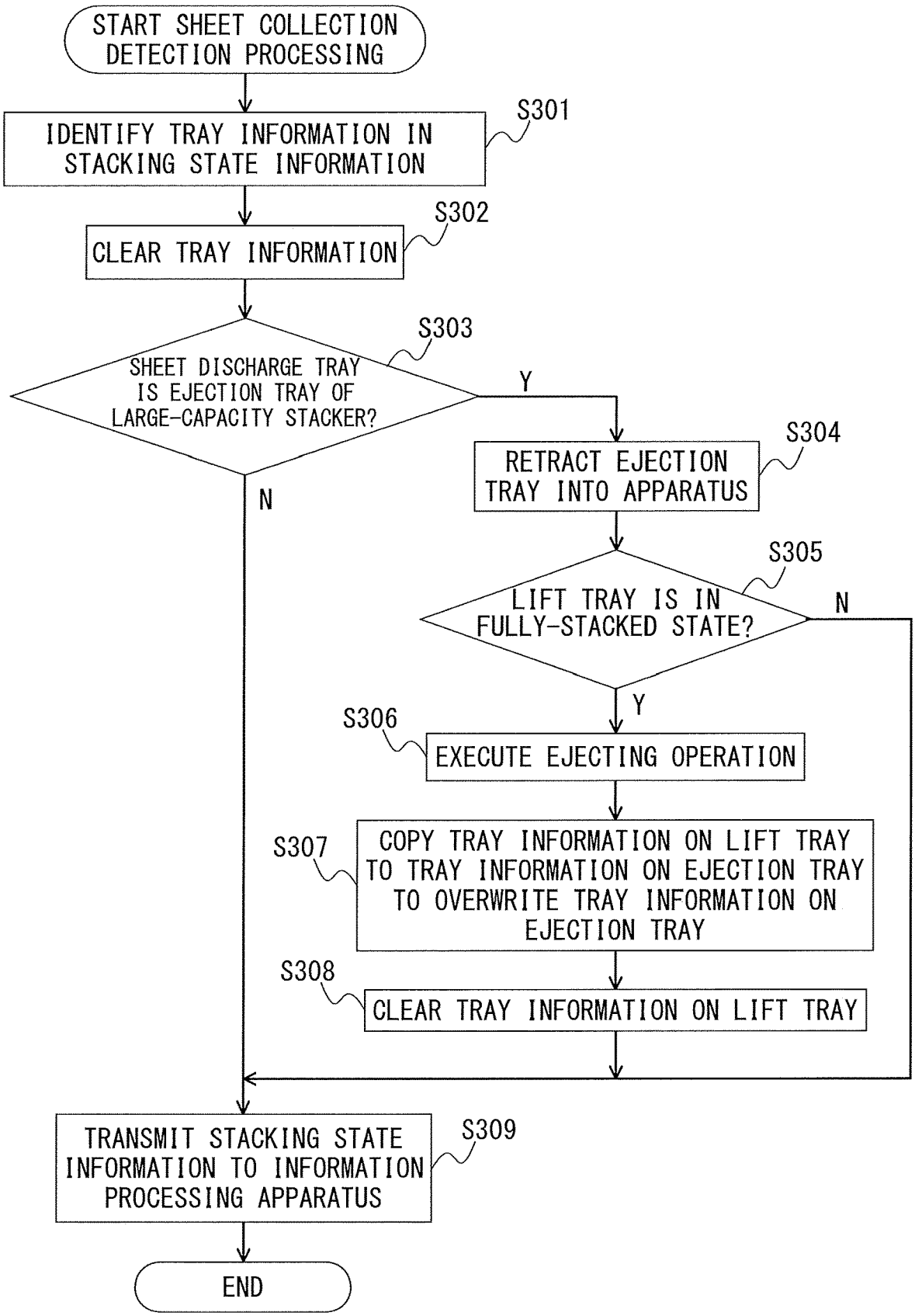
FIG. 10 is a control flow performed when collection of sheets from a sheet discharge tray is detected.

Next, with reference to FIG. 10, description is given of an operation performed when the collection of sheets from the sheet discharge tray is detected in the image forming apparatus 101. Now, description is given of an example in a case in which the sheets are collected from the large-capacity stacker 320. FIG. 10 is a control flow of sheet collection detection processing. This control flow is also executed by the controller 121 integrally controlling the respective portions of the apparatus. The sheet collection is detected when a state in which the sheet presence/absence detection sensors 330 and 331 detect the stacking of the sheet bundles is changed to a state in which the stacking is not detected any more.

The controller 121 refers to the stacking state information 133 to identify the tray information corresponding to the sheet discharge tray at which the sheet collection is detected (Step S301), and then clears the tray information (Step S302). The controller 121 further determines whether or not the sheet discharge tray is the ejection tray 323 of the large-capacity stacker 320 (Step S303). When the sheet discharge tray is the ejection tray 323 (Step S303: Y), the controller 121 retracts the ejection tray 323 into the apparatus (large-capacity stacker 320) (Step S304). Further, the controller 121 determines whether or not the lift tray 322 of the large-capacity stacker 320 at which the sheet collection is detected is in the fully-stacked state (Step S305). When the lift tray 322 is in the fully-stacked state (Step S305: Y), the controller 121 re-stacks the sheets stacked on the lift tray 322 in the fully-stacked state onto the ejection tray 323 to execute the ejecting operation (Step S306). Then, the controller 121 copies, in the stacking state information 133, the tray information on the lift tray 322 for which the ejecting operation is executed, to the tray information on the ejection tray 323 of the large-capacity stacker 320 to overwrite the tray information on the ejection tray 323 (Step S307). After that, the controller 121 clears, in the stacking state information 133, the tray information on the lift tray 322 for which the ejecting operation is executed (Step S308).

When the sheet discharge tray corresponding to the empty tray information is not the ejection tray 323 (Step S303: N), the controller 121 transmits the stacking state information 133 to the information processing apparatus 100 (Step S309), and ends the series of processing. The same processing is performed when the lift tray 322 is not in the fully-stacked state (Step S305: N) and after the tray information on the lift tray 322 is cleared in Step S308.

Figure 11:
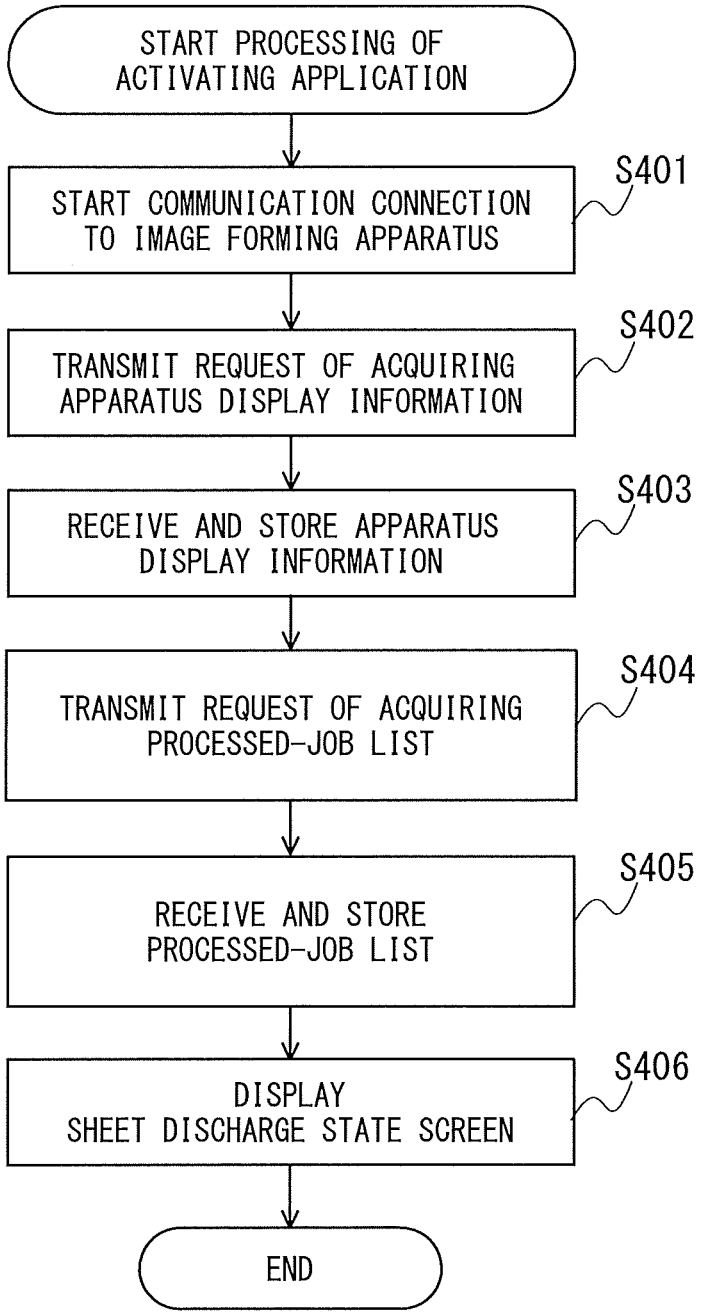
FIG. 11 is a control flow for illustrating an operation procedure of an information processing apparatus.

The operator can recognize the stacking state of each sheet discharge apparatus connected to the image forming apparatus 101 as required by an application executed by the computer program for terminal control in the information processing apparatus 100. The operation of the information processing apparatus 100 at this time is described with reference to FIG. 11. FIG. 11 is a control flow of processing of activating the application. This control flow is executed by the controller 111 integrally controlling the respective portions of the terminal.

When an application is activated in the information processing apparatus 100, the controller 111 starts communication connection to the image forming apparatus 101 (Step S401). The communication connection refers to continuous establishment of a communication path until the operator inputs a clear cancel instruction. When the communication path is established, a request of acquiring the apparatus display information 132 is transmitted to the image forming apparatus 101 (Step S402). When the image forming apparatus 101 (controller 121) receives this acquisition request, the image forming apparatus 101 transmits the apparatus display information 132 corresponding to the current apparatus configuration. When the apparatus display information 132 is updated while the communication connection is established, the image forming apparatus 101 transmits the updated apparatus display information 132 to the information processing apparatus 100. The controller 111 sequentially stores the apparatus display information 132 acquired from the image forming apparatus 101 to the storage 112 (Step S403).

The controller 111 further transmits a request of acquiring the stacking state information and the processed-job list to the image forming apparatus 101 (Step S404). When the image forming apparatus 101 receives this acquisition request, the image forming apparatus 101 (controller 121) transmits the stacking state information 133 and the processed-job list 131 that are currently stored to the information processing apparatus 100. The controller 111 stores the stacking state information 133 and the processed-job list 131 acquired from the image forming apparatus 101 to the storage 112 (Step S405). Further, the controller 111 generates a sheet discharge state screen based on the stored apparatus display information 132, stacking state information 133, and processed-job list 131 to display the sheet discharge state screen on the display 113 (Step S406).

Figure 12:
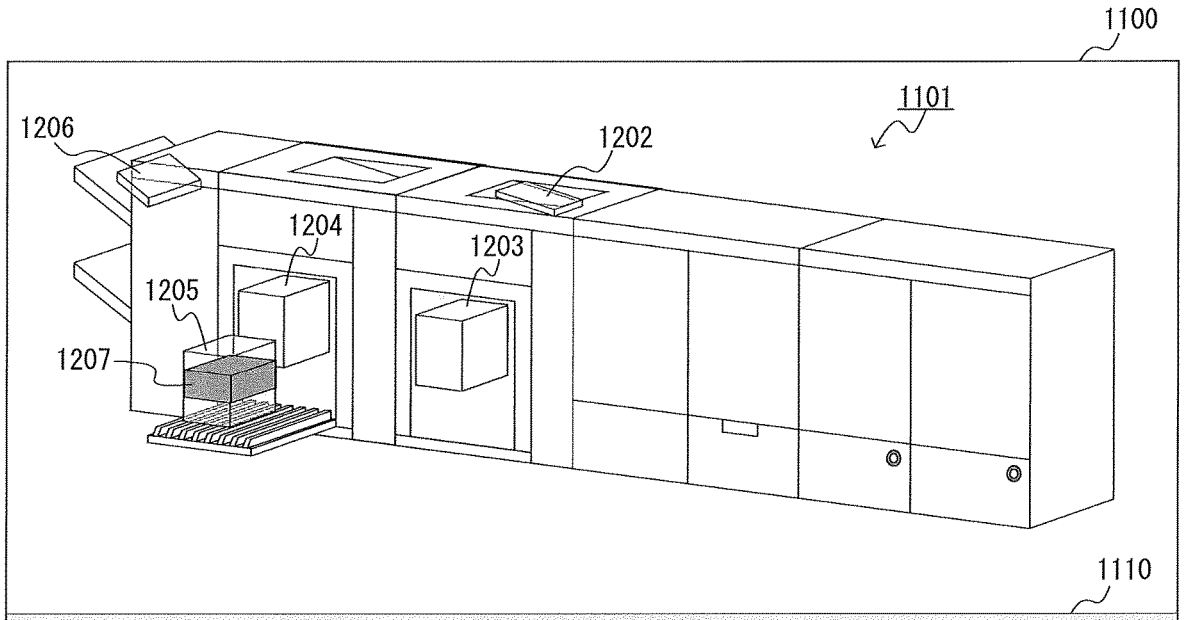
FIG. 12 is a display example of a monitor screen.

An example of the monitor screen is illustrated in FIG. 12. In a monitor screen 1100 exemplified in FIG. 12, an image region 1101 and a list region 1110 are formed. The image region 1101 is a region for displaying a system configuration image that visualizes an arrangement mode of the entire image forming system, and a sheet bundle image that visualizes a stacking state of the sheets having the images formed thereon in the sheet discharge apparatus. The image region 1101 has a two-display-layer structure. That is, the image region 1101 includes a first display layer for displaying the system configuration image, and a second display layer for mapping and displaying a sheet bundle image at the sheet stacking portion of the system configuration image on the first display layer.

In the first display layer, the system configuration image generated based on the apparatus display information 132 stored in Step S403 is displayed. In the second display layer, based on the stacking state information 133 received by the information processing apparatus 100, sheet bundle images 1202 to 1207, which are visualized in a mode corresponding to the sheet stacking state in each sheet discharge tray, are displayed. The display of the sheet bundle images 1202 to 1207 is updated in real time at a timing at which the change in sheet stacking state is detected. That is, the controller 111 is configured so that the mode of displaying the sheet bundle images 1202 to 1207 on the display 113 can be changed in real time for each image forming job.

The list region 1110 is one mode of list display device. In the list region 1110, there is displayed a processed-job list received by the information processing apparatus 100 from the image forming apparatus 101. In the processed-job list, job attributes (job ID, job name, number of pages, number of bundles, and used sheet) of each processed job are displayed. In the processed-job list, the order information is associated with the sheet bundles for the respective trays in the order of time of sheet discharge, and the controller 111 allows the sheet bundle image to be displayed in accordance with the order information. The controller 111 further allows the designated processed job and the sheet bundle image corresponding thereto to be displayed while being distinguished from other processed jobs and the sheet bundle image corresponding thereto.

The operator can operate the input portion 114 to designate any processed job on the processed-job list. In the example of FIG. 12, there is illustrated a state in which a processed job (job name: image forming job #3) having a job ID of "00000003" is designated. When a sheet that is based on the designated image forming job still remains on the sheet discharge tray, the display of the sheet bundle image in the image region 1101 is also changed so that the location of the remaining sheet can be recognized. As in the sheet bundle image 1207, a sheet corresponding to the designated image forming job having the job ID of "00000003" is displayed with a display color different from that of the other sheet bundle images 1202 to 1206. In this manner, the position of the sheet corresponding to the designated image forming job can be easily recognized.

When the number of processed jobs listed in the processed-job list 131 is larger than the number of jobs that can be displayed at one time in the list region 1110, a scroll bar 1111 is used. The operator can operate the scroll bar 1111 to designate any processed job. The designated processed job is displayed in an emphasized (for example, highlighted or inverted) manner to be distinguished from other processed jobs.

Figure 13:
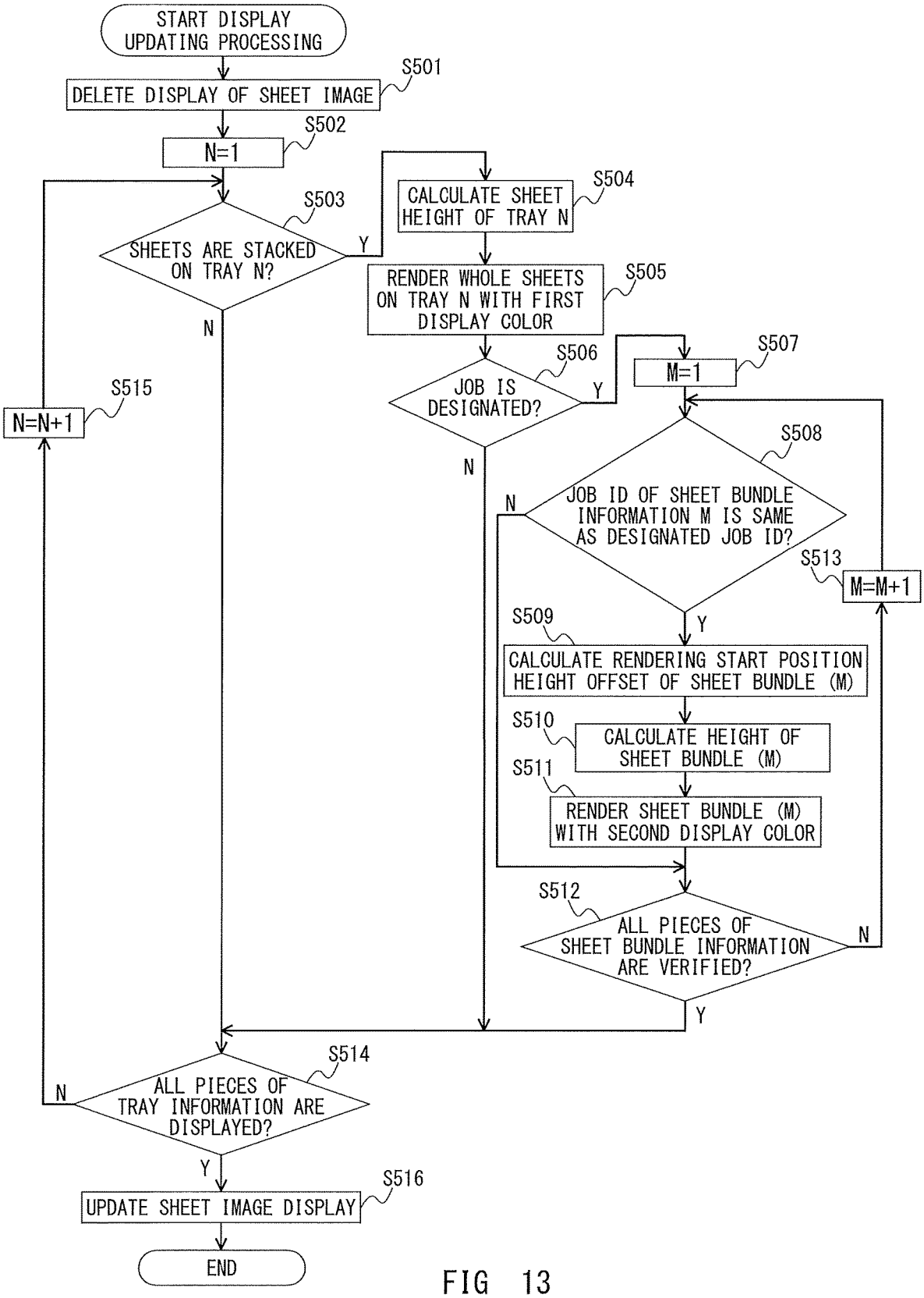
FIG. 13 is a control flow for illustrating another operation procedure of the information processing apparatus.

Next, description is given of an operation example of a case in which the stacking state information is received in the image forming apparatus 101, or a case in which the image forming job or the designated processed job is changed. FIG. 13 is a control flow to be executed by the controller 111 of the information processing apparatus 100 at this time. In FIG. 13, the controller 111 deletes the display of the sheet bundle image displayed in the second display layer of the image region 1101 (Step S501). The controller 111 substitutes 1 for a variable N representing the stacking order of the sheet discharge tray (Step S502), and then determines whether or not the sheets are stacked on the tray N in the stacking state information (Step S503). When the total stacked-sheet number count in the tray information N is 0, it is determined that no sheets are stacked. When the sheets are stacked (Step S503: Y), the controller 111 calculates a height (h1 in FIG. 14A) of the sheet bundle being a group of sheets stacked on the tray N (Step S504). That is, when the entire sheet bundle stacked on the tray N is displayed, the pixel of the height of the sheet bundle is calculated. The height of the sheet bundle is calculated by multiplying the total stacked-sheet number count of the tray information N by a predetermined coefficient P. The coefficient P is a coefficient representing the pixel corresponding to the thickness of one sheet. When the height of the sheet bundle includes a decimal value as a result of calculation, the value is rounded up to an integer value.

After the height of the sheet bundle is calculated, the controller 111 renders the sheet bundle stacked on the tray N with a first display color (Step S505). After that, the controller 111 determines whether or not a job (processed job) is designated in the list region (Step S506). When no job is designated (Step S506: N), the processing proceeds to Step S514. When a job is designated (Step S506: Y), the controller 111 substitutes 1 for a variable M representing the order of the sheet bundle information (Step S507). The sheet bundle information M thereafter represents information relating to the M-th sheet bundle in the sheet bundle information list of the tray information N of the received stacking state information.

The controller 111 then determines whether or not the job ID of the sheet bundle information M is the same as the job ID of the job designated in the list region (Step S508). When the job ID is not the same (Step S508: N), the processing proceeds to Step S512. When the job ID is the same (Step S508: Y), the controller 111 calculates a rendering start height offset (s in FIG. 15A) of the sheet bundle (M) corresponding to the sheet bundle information M (Step S509). The rendering start position height offset of the sheet bundle is calculated by multiplying the rendering start position of the sheet bundle corresponding to the sheet bundle information M by the above-mentioned coefficient P. When the rendering start position height offset includes a decimal value as a result of the calculation, the value is rounded down to an integer value.

After that, the controller 111 calculates the height of the sheet bundle (M) (Step S510). That is, the controller 111 calculates the pixel corresponding to the height of the sheet bundle (M) when the sheet bundle image is displayed on the display 113. The height of the sheet bundle (M) is calculated by multiplying the sheet number count by the above-mentioned coefficient P. When the height of the sheet bundle (M) includes a decimal value as a result of the calculation, the value is rounded up to an integer value.

After the height of the sheet bundle (M) is calculated, the controller Ill 1 renders a part of the sheet bundle (M) with a second display color (Step S511). In this manner, the part of the sheet bundle (M) corresponding to the designated processed job is displayed with the second display color. After the part of the sheet bundle (M) is displayed with the second display color (Step S511), the controller 111 determines whether or not all pieces of sheet bundle information in the sheet bundle information list of the tray information N have been verified (Step S512). When all pieces of sheet bundle information have been verified (Step S512: Y), the processing proceeds to Step S514. When the verification of all pieces of sheet bundle information is not finished yet (Step S512: N), the controller 111 adds 1 to the variable M (Step S513), and the processing returns to Step S508.

After that, the controller 111 determines whether or not all pieces of tray information in the received stacking state information have been displayed (Step S514). When display of all pieces of tray information is finished (Step S514: Y), the controller 111 updates the display of the sheet bundle image in the second display layer (Step S516), and the series of processing is ended. When display of all pieces of tray information is not finished (Step S514: N), the controller 111 adds 1 to the variable N (Step S515), and the processing returns to Step S503.

Now, a method of rendering the sheet bundle image to be rendered in Step S505 is described with reference to FIG. 14A to FIG. 14C. In this case, as an example, description is given of a method of rendering whole sheets on the ejection tray of the large-capacity stacker. A height (h1 of FIG. 14A) of a rendered sheet bundle image 1401 is the height of the whole sheets calculated in Step S504. The sheet bundle image 1401 is rendered by seven points of vertex A to vertex G. In a list 1402 of FIG. 14B, which represents a method of calculating the coordinates of each vertex, the vertex A has tray position coordinates (coordinate values thereof are expressed as (x, y)) in the sheet discharge tray. The tray position coordinates of each sheet discharge tray are stored in the apparatus display information 132 stored in Step S403. The coordinate values of other vertices (B to G) are determined by adding or subtracting a predetermined offset value and the sheet height h1 to or from the coordinate values (x, y) of the vertex A.

The sheet bundle image 1401 is rendered by a rendering command of, for example, scalable vector graphics (SVG). In FIG. 14C, there is shown an example of a rendering command 1403 of the sheet bundle image 1401 at the time when the SVG is used. The shape of the sheet bundle image 1401 differs depending on the shape of the corresponding sheet discharge tray, but the point that the shape is determined based on the tray position coordinates, the predetermined offset value, and the sheet height is the same.

Next, a method of rendering the sheet bundle image to be rendered in Step S511 is described with reference to FIG. 15A to FIG. 15C. In this case, description is given of a method of rendering a sheet bundle image (part of sheet bundle (M)) corresponding to the designated processed job in the ejection tray of the large-capacity stacker. FIG. 15A is an illustration of a sheet bundle image 1501 representing the shape and the size of the sheet bundle (M). The height (h2 in FIG. 15A) of the sheet bundle (M) is the height of the sheet bundle (M) calculated in Step S510. The sheet bundle (M) is rendered by seven points of vertex H to vertex N. FIG. 15B is an illustration of a list 1502 representing the method of calculating the coordinates of each vertex. The vertex A has tray position coordinates (coordinate values thereof are expressed as (x, y)) in the sheet discharge tray. The vertex H is determined based on the vertex A and a rendering start position height offset s of the sheet bundle (M) calculated in Step S509. The coordinate values of other vertices (I to N) are determined by adding or subtracting the predetermined rendering start position offset s and the sheet height h2 to or from the coordinate values of the vertex H. FIG. 15C represents a rendering command of the sheet bundle image 1501 at the time when the command is expressed with use of the SVG. The shape of the sheet bundle image differs depending on the shape of the corresponding sheet discharge tray, but the point that the shape is determined based on the tray position coordinates, the predetermined offset, the rendering start position height of the sheet bundle (M), and the height of the sheet bundle (M) is the same.

Figure 16:
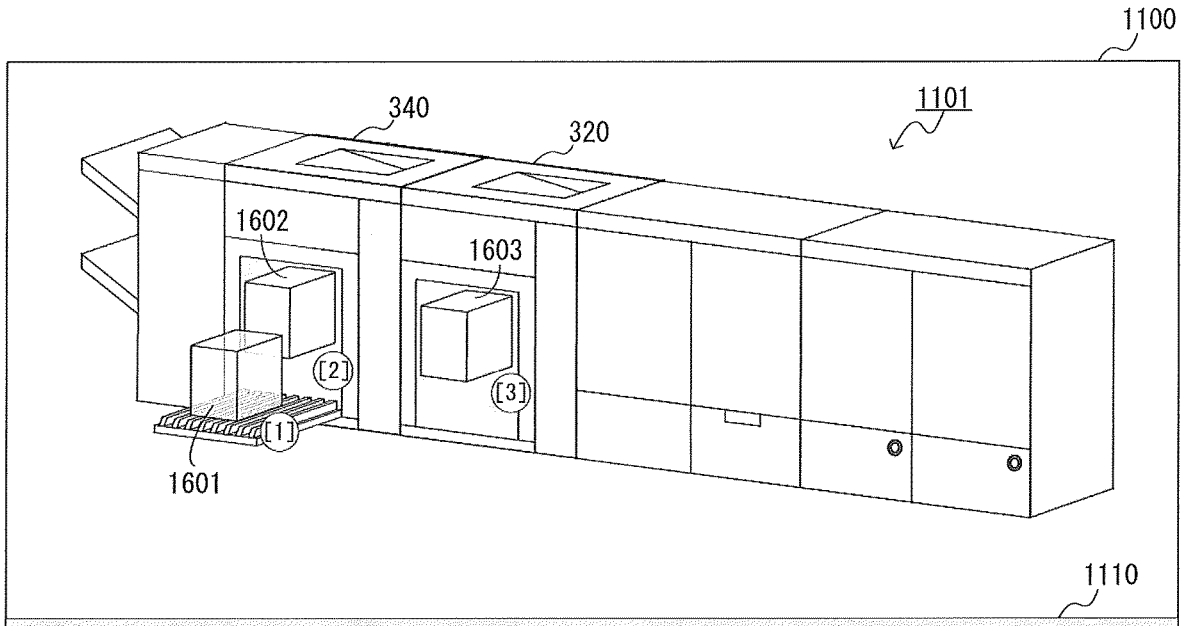
FIG. 16 is a display example of the monitor screen.

FIG. 16 is a diagram for illustrating the content displayed when a job is not selected in the monitor screen displayed on the display 113 of the information processing apparatus 100. In the image region 1101 of the monitor screen 1100, a current sheet stacking state is displayed. In the example of FIG. 16, on the image of the ejection tray of the large-capacity stacker 340, a sheet bundle image 1601 representing the sheet bundle stacked thereon is mapped. Further, similarly on the image of the lift tray of the large-capacity stacker 340, a sheet bundle image 1602 representing the sheet bundle stacked thereon is mapped. Further, on the image of the lift tray of the large-capacity stacker 320, a sheet bundle image 1603 representing the sheet bundle stacked thereon is mapped.

In the example of FIG. 16, a job is not designated in the list region 1110. Therefore, unlike the illustration in FIG. 12, there is no display of the sheet bundle image 1207 in which the sheet bundle is displayed with a different display color. However, order information such as Numerals [1], [2], and [3] can be displayed around the respective sheet bundle images 1601, 1602, and 1603. The order information is described later, but the sheet bundle corresponding to each tray is provided with the order information, for example, is numbered in the order of time of sheet discharge. As the number is increased, the sheet is discharged later. The sheet discharge in the first embodiment is back-side sheet discharge in which the front side faces downward, and hence the operator can collect the sheet bundles in the order of discharge by only taking out the sheet bundles corresponding to the sheet bundle images 1601 to 1603 in the order of Numerals [1] to [3], and stacking, onto the sheet bundle taken out previously, the sheet bundle taken out next.

Figure 17:
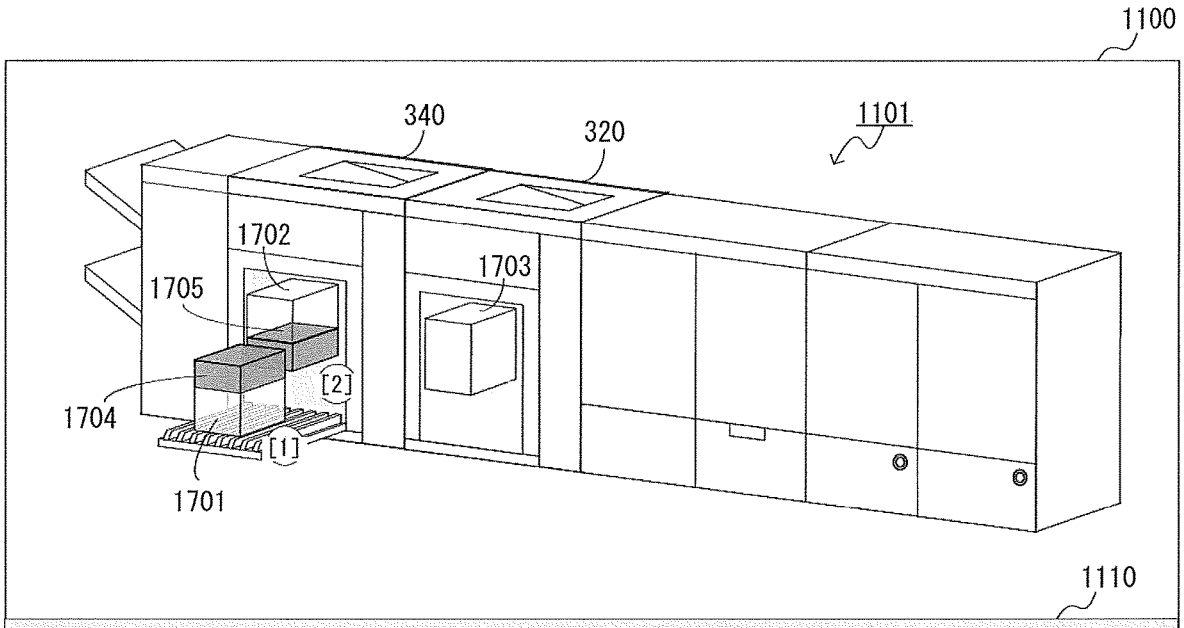
FIG. 17 is a diagram for illustrating a state of change in monitor screen at the time when a processed job is designated.

FIG. 17 is an illustration of a state of change in image region 1101 at the time when a job is designated from the display state of FIG. 16. In the example illustrated in FIG. 17, it is assumed that a job having a job ID of "00000004" is designated in the list region 1110. In comparison to FIG. 16, the sheet bundle image 1601 of FIG. 16 corresponds to a sheet bundle image 1701 of FIG. 17. Further, the sheet bundle image 1602 of FIG. 16 corresponds to a sheet bundle image 1702 of FIG. 17. Similarly, the sheet bundle image 1603 of FIG. 16 corresponds to a sheet bundle image 1703 of FIG. 17.

A sheet bundle image 1704 and a sheet bundle image 1705 are each a sheet bundle image representing a sheet bundle part of the job having the job ID of "00000004" designated in the list region 1110, and are mapped to the ejection tray and the lift tray of the large-capacity stacker 340 in a divided manner. Numerals [1] and [2] are order information representing the order of taking out the sheet bundles corresponding to the job having the job ID of "00000004" designated in the list region 1110. In the first embodiment, when no job is designated, the order information representing the order of taking out all sheet bundles stacked on the respective trays is displayed as illustrated in FIG. 16, and when a job is designated, the order information representing the order of taking out the sheet bundles corresponding to the designated job is displayed. Therefore, the sheet bundle image 1703, which is mapped to the tray of the large-capacity stacker 320, does not include the sheet bundle corresponding to the job having the job ID of "00000004", and hence the order information is not displayed on the sheet bundle image 1703. The order information on all sheet bundles may be always displayed, and the order information on the sheet bundles corresponding to the designated job may be displayed at a position different from that of the order information on all sheet bundles.

Figure 18:
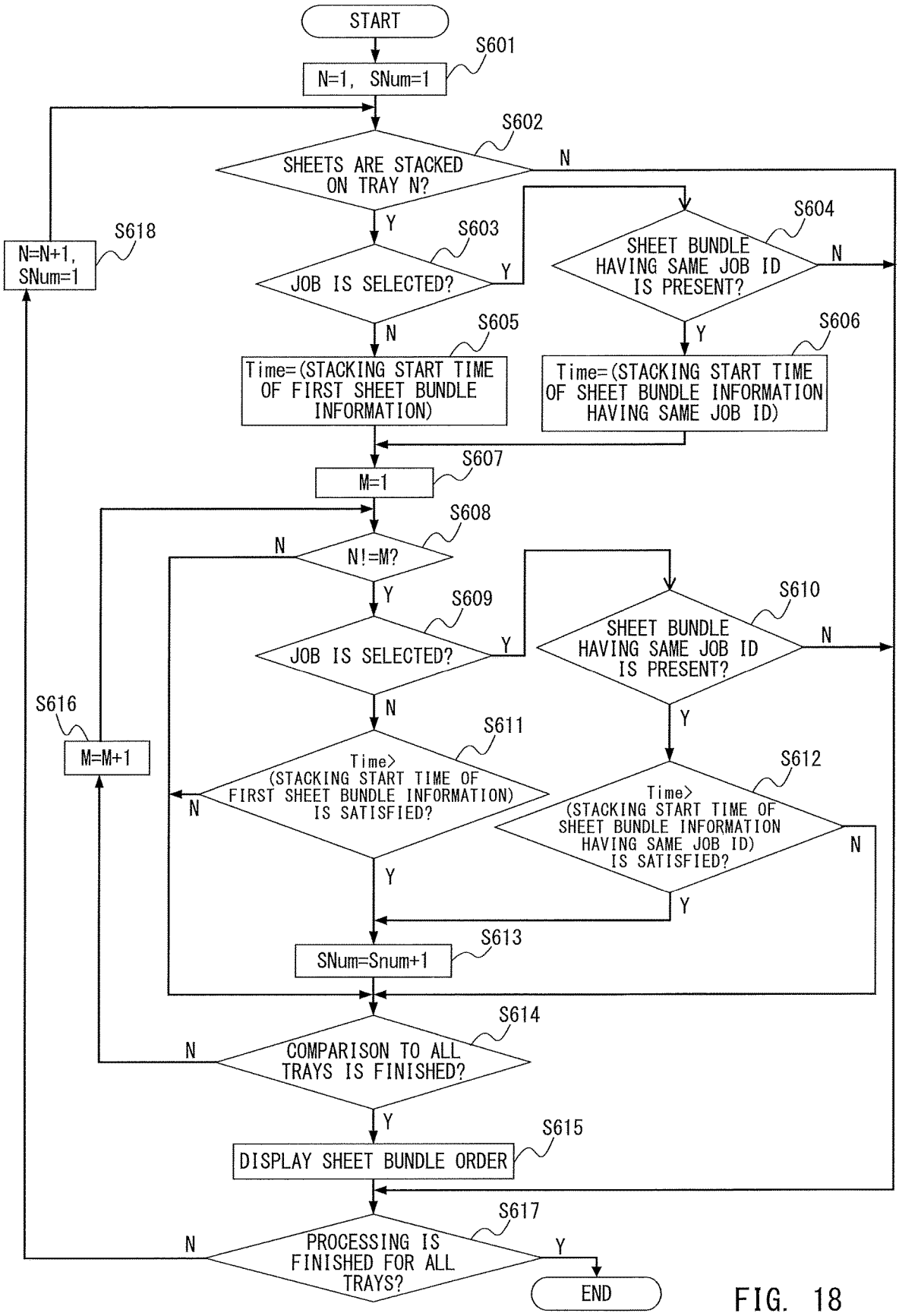
FIG. 18 is a control flow performed when order information is displayed.

FIG. 18 is a control flow performed when the above-mentioned order information is displayed. This control flow is a detailed flow of the processing of Step S516 of FIG. 13. That is, the controller 111 initializes the variable N representing the order of the trays and a variable SNum of the number representing the order of the sheet bundles (Step S601). Specifically, 1 is substituted for those variables. After that, the controller 111 determines whether or not sheets are stacked on the tray N in the received stacking state information (Step S602). Whether or not the sheets are stacked is determined by focusing on the total stacked-sheet number count of the tray information on the tray N. When the total stacked-sheet number count is 0, no sheets are stacked. When no sheets are stacked (Step S602: N), the processing proceeds to Step S617.

When sheets are stacked, the controller 111 determines whether or not a job is designated in the list region 1110 (Step S603). When a job is designated (Step S603: Y), the controller 111 performs a search to determine whether or not a sheet bundle having the same job ID as the processed job designated in the list region 1110 is present on the tray N (Step S604). This search is performed by searching for the sheet bundle information of the tray information N in the stacking state information. When no such sheet bundle is present (Step S604: N), the processing proceeds to Step S617.

When no processed job is designated in Step S603 (Step S603: N), the controller 111 substitutes a stacking start time of the first sheet bundle information of the tray information N for a stacking start time, and the processing proceeds to Step S607. Further, when a sheet bundle having the same job ID as the designated processed job is present in Step S604 (Step S604: Y), the controller 111 substitutes a stacking start time of the sheet bundle information that is first determined as having the same job ID by the search in Step S604 for the stacking start time, and the processing proceeds to Step S607. In Step S607, the controller 111 initializes the variable representing the order of the trays. Specifically, the controller 111 substitutes 1 for the variable M.

After that, the controller 111 compares the variable N with the variable M (Step S608). When the variables differ from each other (Step S608: Y), as in Step S603, the controller 111 determines whether or not a job is designated (Step S609). When a job is designated (Step S609: Y), as in Step S604, the controller Ill 1 performs a search to determine whether or not a sheet bundle having the same job ID as the designated job is present (Step S610). When no such sheet bundle is present (Step S610: N), the processing proceeds to Step S617. When no job is designated in Step S609 (Step S609: N), the controller 111 compares the stacking start time with the stacking start time of the first sheet bundle information of the tray information M (Step S611). When the stacking start time Time is larger (Step S611: Y), the controller 111 adds 1 to the variable SNum (Step S613). After that, the processing proceeds to Step S614. When a sheet bundle having the same job ID as the designated job is present in Step S610 (Step S610: Y), the controller 111 compares the stacking start time Time with the stacking start time of the sheet bundle information that is first determined as having the same job ID by the search in Step S610 (Step S612). Then, when the stacking start time Time is larger (Step S612: Y), the processing proceeds to Step S613. Otherwise, the processing proceeds to Step S614.

In Step S614, the controller 111 determines whether or not the stacking start time has been compared to those of all trays. When the comparison is finished (Step S614: Y), the controller 111 displays the order information on the sheet bundles indicated by Numerals [1] to [3] in FIG. 16 and FIG. 17 at positions of the tray N with a number of the variable SNum (Step S615). When the comparison is not finished (Step S614: N), the controller 111 adds 1 to the variable M (Step S616), and the processing returns to Step S608. The controller 111 determines whether or not the above-mentioned processing has been finished for all of the trays (Step S617). When the processing is not finished (Step S617: N), the controller 111 adds 1 to the variable N representing the order of the trays (Step S618), and the processing returns to Step S602.

In this control flow, the order information on the sheet bundles is displayed for all of the trays, but the order information may be displayed only for the tray to be subjected to a successive tray switching operation. With the image forming apparatus as described above, the positions and the order of the sheet bundles stacked on a plurality of sheet discharge trays can be recognized in the unit of image forming job. In this manner, the sheet bundles stacked on the plurality of sheet discharge trays can be easily taken out in a correct order in the unit of job, and the convenience is enhanced.

Second Embodiment

In the first embodiment, the following example is described. Every time the state of the sheet discharge tray changes, the order information on the sheet bundles is displayed in the order from 1 in the order starting with the earliest sheets stacked onto the trays. In this manner, the position of the sheet bundle in the current sheet discharge tray state and the order of the sheet bundles that can be taken out can be recognized. In the image forming apparatus 101 in the first embodiment, the order information is always displayed with numbers in series in the order from 1, and hence the first embodiment is suitable for a case in which the sheet bundles are taken out in order. However, when the sheet bundle in the middle is erroneously taken out earlier, the order information is displayed with numbers in series starting from 1 again, and hence the fact that the bundle in the middle has already been taken out cannot be known. In view of this, in a second embodiment of the present disclosure, description is given of an example in which, in the unit of job, sheet bundle numbers are stored in the order from 1, and the sheet bundle numbers are displayed as the order information on the sheet bundles that can be taken out. In this manner, even when the sheet bundle in the middle is taken out earlier, the number of the sheet bundle that has been taken out earlier can be determined because the order information on the sheet bundles does not have numbers in series.

Figure 19:
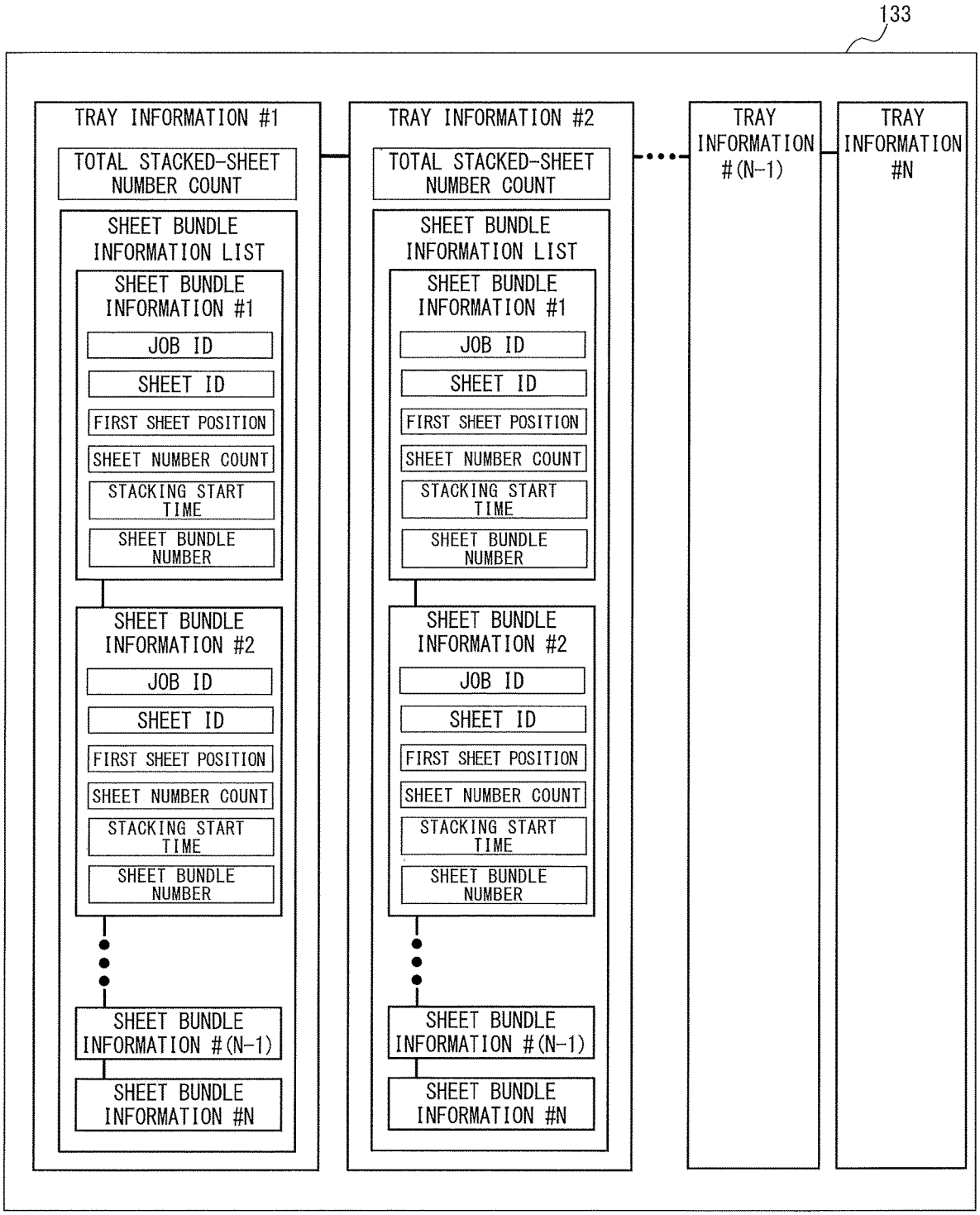
FIG. 19 is a diagram for illustrating stacking state information in a second embodiment of the present disclosure.
Figure 20A:
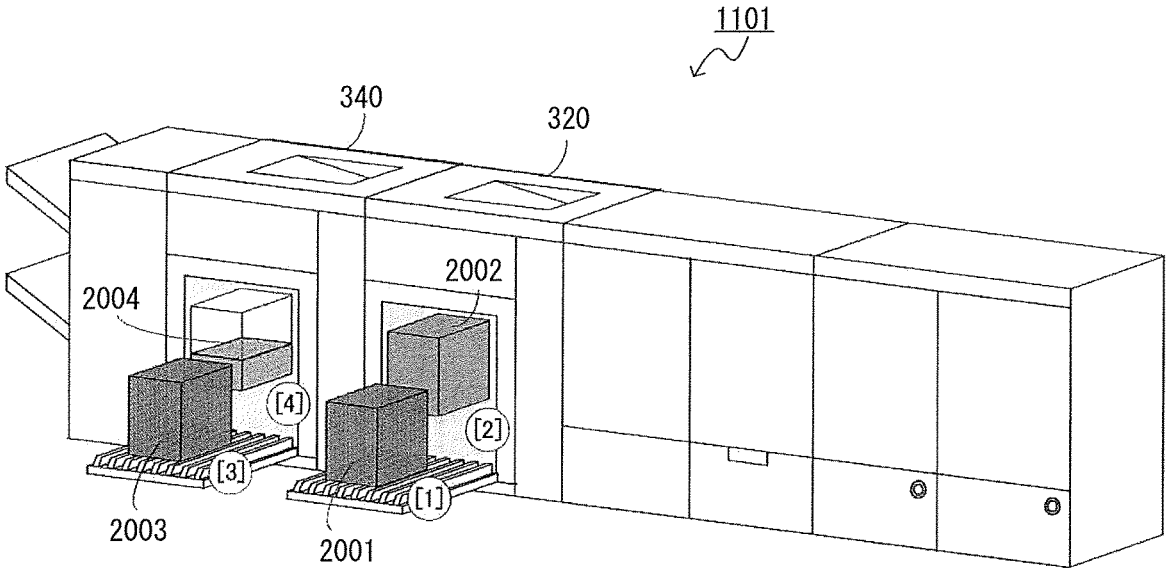
FIG. 20A and FIG. 20B are views of display of order information on sheet bundles at the time when the sheet bundles are taken out.
Figure 20B:
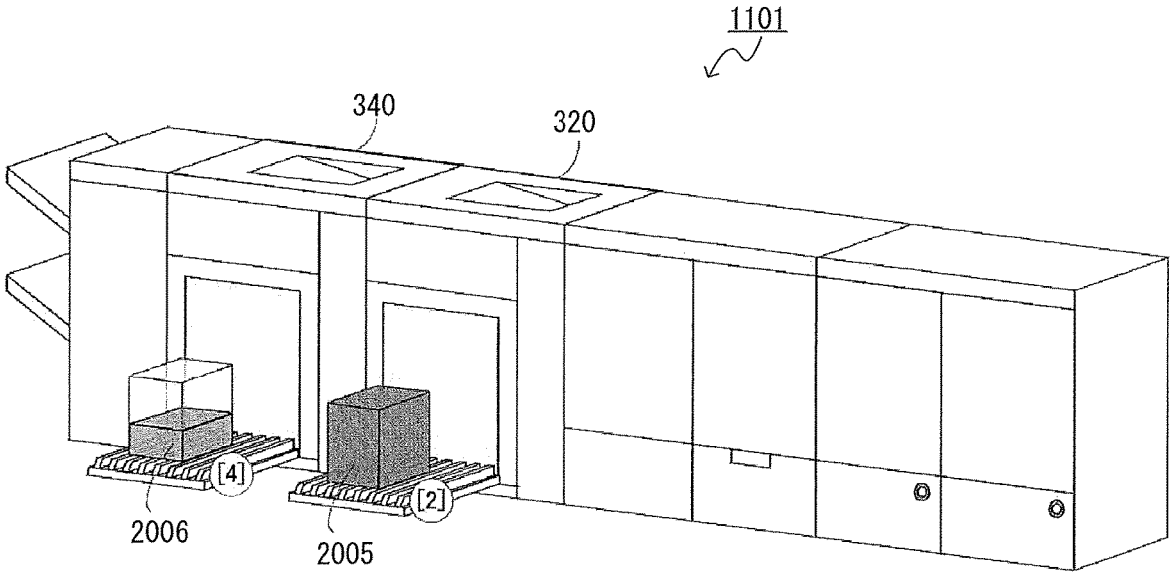

FIG. 19 is an diagram for illustrating the stacking state information 133 in the second embodiment. For the sake of convenience, the sheet bundle number is added to each piece of sheet bundle information (#1 to #N) of the stacking state information in the diagram of FIG. 7. The sheet bundle number is a number given in the order from 1 in the job having the same job ID, and is information that does not change until the sheet bundle is taken out from the tray and the sheet bundle information is initialized. FIG. 20A and FIG. 20B are views of display of the order information on the sheet bundles at the time when the sheet bundles are taken out in the second embodiment. FIG. 20A and FIG. 20B are illustrations of display examples of the image region 1101 under a state in which a job is selected in the list region 1110 as in FIG. 17. First, FIG. 20A is a display example of the image region 1101 under a state in which sheet bundles 2001 to 2004 corresponding to a job are stacked onto four trays in a divided manner, and the sheet bundles are not taken out yet. The sheet bundles are not taken out, and hence Numerals [1] to [4] are displayed as the order information on the sheet bundles. When the sheet bundles 2001 and 2003 are taken out from this state, the display changes as from FIG. 20A to FIG. 20B, for example. In FIG. 20B, a sheet bundle 2005 corresponds to the sheet bundle 2002 of FIG. 20A, and a sheet bundle 2006 corresponds to the sheet bundle 2004 of FIG. 20A. In the second embodiment, the sheet IDs in the job are displayed as the order information on the sheet bundles, and hence the order information on the sheet bundle 2005 and the order information on the sheet bundle 2006 are still Numerals [2] and [4], respectively, even when the sheet bundles 2005 and 2006 are ejected. Therefore, by seeing the display of FIG. 20B, the operator can know that the sheet bundle 2001 corresponding to the order information [1] and the sheet bundle 2003 corresponding to the order information [3] have already been taken out because the order information does not have numbers in series.

Figure 21:
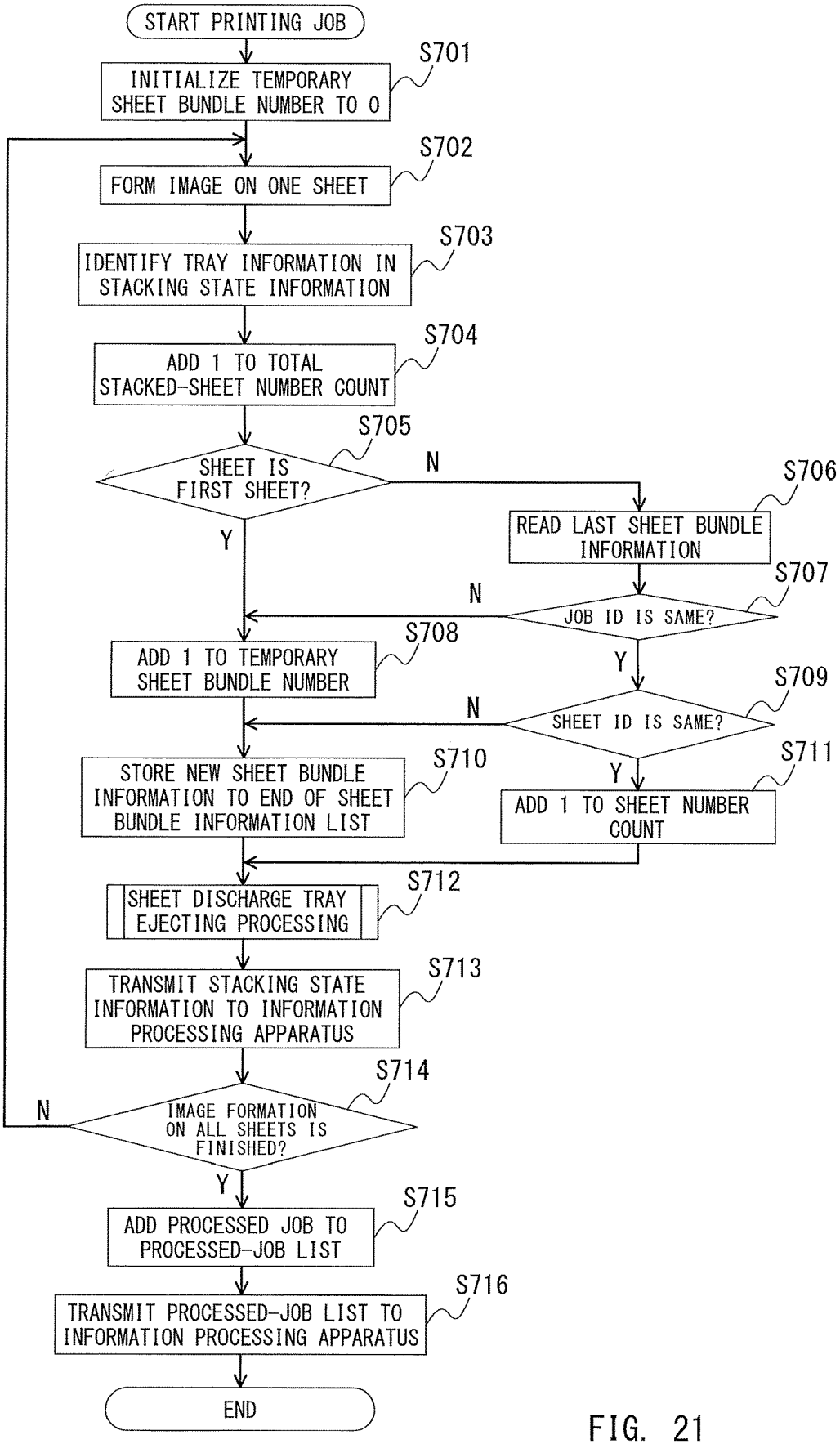
FIG. 21 is a control flow performed when an image forming job is executed in the second embodiment.

Next, with reference to FIG. 21, description is given of an example of operation of the image forming apparatus 101 performed when the image forming job is executed in the second embodiment. It is assumed that the image forming job is received from, for example, the information processing apparatus 100. The image forming job includes designation of tray information on the sheet stacking portion, that is, the sheet discharge apparatus to be used. In the following description, for the sake of convenience, it is assumed that the tray information on the large-capacity stacker 320 is designated. FIG. 21 is a control flow of the image forming apparatus 101 at this time. This control flow is also executed by the controller 121 integrally controlling the respective portions of the apparatus.

When a printing job is started in the image forming apparatus 101, the controller 121 initializes a temporary sheet bundle number of internal data of the job to 0 (Step S701). The "temporary sheet bundle number" refers to a number that is temporarily used before the sheet bundle number is determined and can be freely updated. The controller 121 next forms an image on one sheet in the order of pages in accordance with the image forming job (Step S702). After the image formation, the conveyance of the sheet is started toward the large-capacity stacker 320 designated in the image forming job. At this time, the controller 121 identifies the tray information on the designated large-capacity stacker 320 (Step S703). The procedure of identifying the tray information is the same as that described with reference to FIG. 9. The controller 121 adds 1 to the total stacked-sheet number count of the identified tray information (Step S704). The controller 121 further determines whether or not the discharged sheet is the first sheet in the sheet discharge tray based on the value of the total stacked-sheet number count (Step S705). When the sheet is not the first sheet (Step S705: N), the controller 121 refers to the tray information to read last sheet bundle information in the sheet bundle information list (Step S706). Then, the controller 121 determines whether or not the job ID of the job for which the image formation is performed is the same as the job ID in the sheet bundle information read in Step S706 (Step S707). When the job ID is the same (Step S707: Y), the controller 121 determines whether or not the sheet ID of the sheet printed in Step S702 is the same as the sheet ID in the sheet bundle information read in Step S706 (Step S709). When the sheet ID is the same (Step S709: Y), the controller 121 adds 1 to the sheet number count of the last sheet bundle information in the tray information (Step S711), and the processing proceeds to Step S712.

When the sheet is the first sheet in Step S705 (Step S705: Y), or when the job ID differs in Step S707 (Step S707: N), the controller 121 adds 1 to the temporary sheet bundle number (Step S708), and the processing proceeds to Step S710. The same holds true in the case in which the sheet ID differs in Step S709 (Step S709: N). In Step S710, the controller 121 generates new sheet bundle information at the end of the sheet bundle information list in the tray information. The member variables of the generated new sheet bundle information are as follows.

First, the "job ID" is a job ID of the printing job. The "sheet ID" is a sheet ID corresponding to a sheet subjected to image formation in Step S702. As the "first sheet position", the total stacked-sheet number count is input. The "sheet number count" is 1. As the "stacking start time", the time at which the sheet bundle information is generated is input. As the "sheet bundle number", the temporary sheet bundle number is input. New sheet bundle information is generated when the sheet 1D differs in Step S709, but as the sheet bundle number, similarly to the job ID, the same sheet bundle number as that in the sheet bundle information read in Step S706 is input. Next, when the sheet discharge tray designated by the image forming job in Step S702 is the lift tray of the large-capacity stacker 320, the controller 121 performs ejecting processing based on whether or not the fully-stacked state is obtained (Step S712). This ejection processing is the same as that in Steps S210 to S215 of FIG. 9, and hence the ejection processing is collectively illustrated as Step S712 in FIG. 21. After that, the controller 121 transmits the stacking state information 133 to the information processing apparatus 100 (Step S713), and determines whether or not image formation on all sheets corresponding to the image forming job is finished (Step S714). When the image formation is not finished (Step S714: N), the processing returns to Step S702. When the image formation on all sheets is finished (Step S714: Y), the controller 121 lists (adds) the image forming job for which the processing has been finished to the processed-job list 131 as the processed job (Step S715). Then, the controller 121 transmits the processed-job list 131 that has been updated based on the addition to the information processing apparatus 100 (Step S716), and the series of processing is ended.

Figure 22:
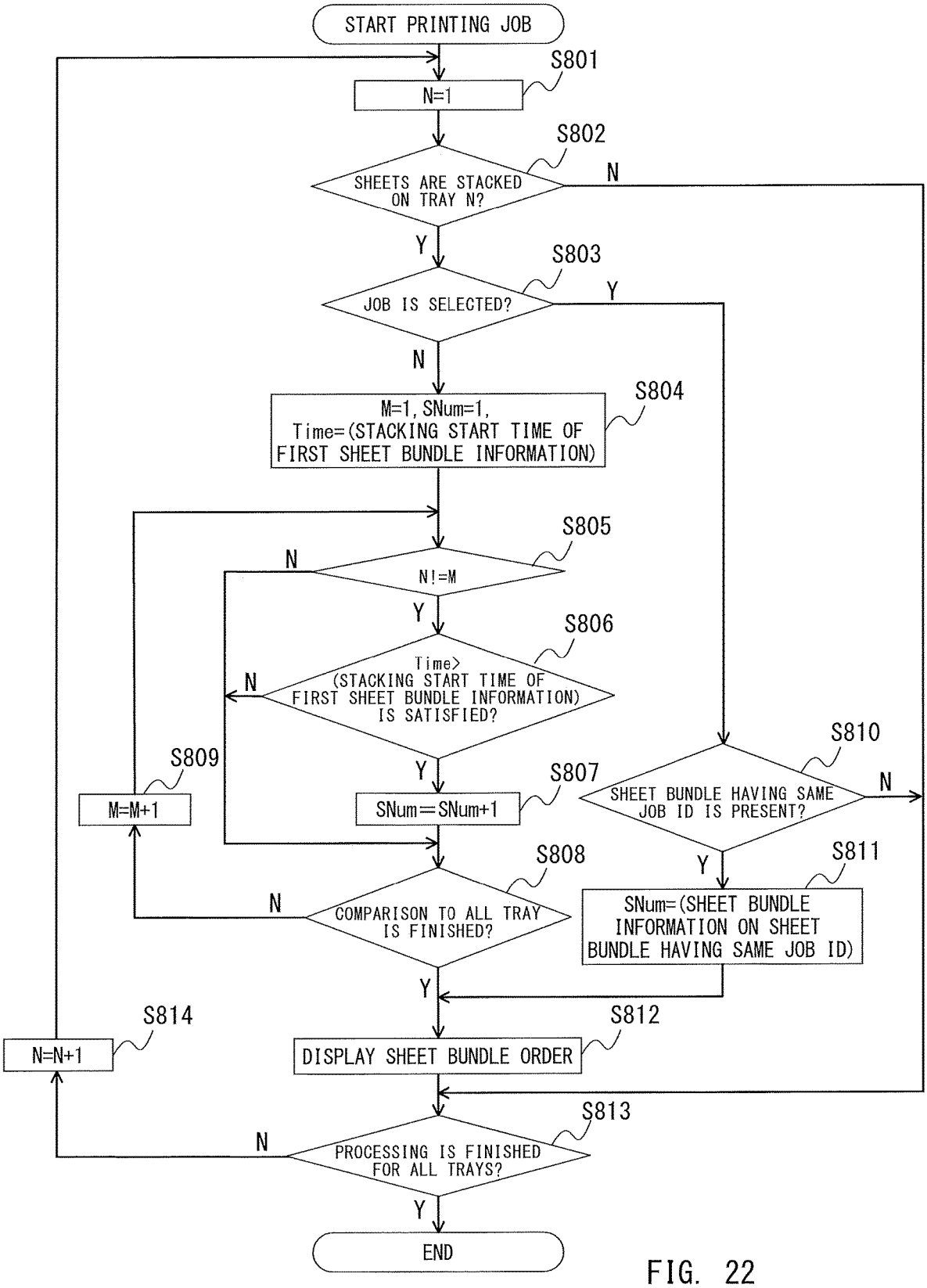
FIG. 22 is a control flow performed when the order information is displayed in the second embodiment.

FIG. 22 is a control flow performed when the order information on the sheet bundles is displayed in the second embodiment. This control flow is a detailed flow of the processing of Step S516 of FIG. 13, which has been described in the first embodiment. The controller 111 initializes the variable N representing the order of the trays (Step S801). Specifically, 1 is substituted for the variable. After that, the controller 111 determines whether or not sheets are stacked on the tray N in the received stacking state information (Step S802). Whether the sheets are stacked is determined by focusing on the total stacked-sheet number count of the tray information of the tray N. When the total stacked-sheet number count is 0, no sheets are stacked. When no sheets are stacked (Step S802: N), the processing proceeds to Step S813.

When sheets are stacked, the controller 111 determines whether or not a job (for example, image forming job, the same holds true in the following control flow of FIG. 22) is designated in the list region 1110 (Step S803). When a job is designated (Step S803: Y), the controller 111 performs a search to determine whether or not a sheet bundle having the same job ID as the processed job designated in the list region 1110 is present on the tray N (Step S810). This search is performed by searching for the sheet bundle information of the tray information N in the stacking state information. When no such sheet bundle is present (Step S810: N), the processing proceeds to Step S813. When such sheet bundle is present (Step S810: Y), the controller 111 substitutes the sheet bundle number of the sheet bundle information that is first determined as having the same job ID by the search in Step S810 for the variable SNum of the number representing the order of the sheet bundles (Step S811), and the processing proceeds to Step S812.

In Step S803, when no processed job is designated (Step S803: N), the controller 111 initializes the variables to be used in the following control flow (Step S804). Specifically, 1 is substituted for the variable M representing the order of the trays and the variable SNum of the number representing the order of the sheet bundles, and the stacking start time of the first sheet bundle information of the tray information N is substituted for the stacking start time Time. After that, the controller Ill 1 compares the variable N with the variable M (Step S805). When the variables differ from each other (Step S805: Y), the controller 111 compares the stacking start time with the stacking start time of the first sheet bundle information of the tray information M (Step S806). When the stacking start time is larger (Step S806: Y), the controller 111 adds 1 to the variable SNum (Step S807). After that, the processing proceeds to Step S808.

In Step S808, the controller 111 determines whether or not the stacking start time has been compared to those of all trays. When the comparison is finished (Step S808: Y), the controller 111 displays the order information on the sheet bundles indicated by Numerals [1] to [4] in FIG. 16, FIG. 17, FIG. 20A, and FIG. 20B at positions of the tray N with a number of the variable SNum (Step S812). When the comparison is not finished (Step S808: N), the controller 111 adds 1 to the variable M (Step S809), and the processing returns to Step S805. The controller 111 determines whether or not the above-mentioned processing has been finished for all of the trays (Step S813). When the processing is not finished (Step S813: N), the controller 111 adds 1 to the variable N representing the order of the trays (Step S814), and the processing returns to Step S801.

In the control flow, the sheet bundle number is displayed only when a job is designated in the list region 1110. When a job is not designated, similarly to the first embodiment, the order information is displayed with numbers in series from 1 in the stacking order starting with the earliest sheet bundles stacked onto the trays. This is because, in the second embodiment, the sheet bundle numbers are numbers in series starting from 1 in the job, and hence the order information becomes useless when sheets corresponding to a different job are stacked. With the above-mentioned image forming apparatus, the positions and the order of the sheet bundles stacked on a plurality of sheet discharge trays can be recognized in the unit of image forming job, and even when a bundle in the middle of the job is taken out earlier, the fact that the bundle in the middle has been taken out can be determined. In this manner, the sheet bundles stacked on the plurality of sheet discharge trays can be easily taken out in a correct order in the unit of job, and the convenience is enhanced. As described above, according to the second embodiment, the order of taking out the sheets having the images formed thereon is displayed together with the sheet bundle images, and hence the sheets stacked on a plurality of portions can be easily taken out in a correct order for each image forming job.

Other Embodiments

In the first embodiment and the second embodiment, a configuration example in which the information processing apparatus 100 and the image forming apparatus 101 are separate members is described, but the image forming apparatus 101 may have the functions of the information processing apparatus 100. That is, the image forming apparatus 101 may include the storage 112, the display 113, and the input portion 114. In this case, the functions of generating the system configuration image and the sheet bundle image are achieved by the controller 121. That is, the controller 121 generates the system configuration image and the sheet bundle image, and displays the generated system configuration image and the generated sheet bundle image on the display 113. Further, the controller 121 operates as control device for updating the display of the sheet bundle image every time the detection result is acquired from the sheet presence/absence detection sensor 330 or the like.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-101134, filed May 22, 2017 and Japanese Patent Application No. 2017-243732, filed Dec. 20, 2017 which are hereby incorporated by reference herein in their entirety.

What is claimed is:

1. A control device for controlling a system having an image forming apparatus configured to form an image on a sheet based on an image forming job, and a sheet discharge apparatus having a stacking tray on which the sheet, having the image formed on the sheet, is to be stacked, the control device comprising:

a generator configured to generate a system configuration image representing a configuration of the system, and to generate a sheet bundle image representing a sheet bundle stacked on the stacking tray;

a display controller configured to display, on a display, a screen in which the sheet bundle image is combined at a position of the stacking tray in the system configuration image; and an input portion configured to input designation of an image forming job which corresponds to sheets to be taken out and which is a processed image forming job selected among processed image forming jobs included in an execution history list, wherein, in a case where the sheets of the selected image forming job are divided and discharged on a plurality of stacking trays, the display controller is configured to:

display a first sheet bundle image, which represents a part of the sheets of the selected image forming job, and a second sheet bundle image, which represents a part of the sheets of the selected image forming job, in a first display color, wherein the first sheet bundle image represents a first sheet bundle stacked on a first stacking tray among the plurality of stacking trays, and wherein the second sheet bundle image represents a second sheet bundle stacked on a second stacking tray among the plurality of stacking trays, display a third sheet bundle image in a second display color which is different from the first display color, wherein the third sheet bundle image represents a third sheet bundle, which are stacked on one of the plurality of stacking trays, including sheets of another processed image forming job, and display an order of taking out of the first sheet bundle and the second sheet bundle using the first sheet bundle image, the second sheet bundle image, and the third sheet bundle image.

2. The control device according to claim 1, wherein the display controller is configured to display the sheet bundle image corresponding to the image forming job designated through the input portion in a mode that is different from a mode for another image forming job.

3. The control device according to claim 1, wherein the sheet discharge apparatus includes a stacker having a lift tray and an ejection tray, wherein the lift tray is positioned at a stacking portion with a predetermined height under a state in which no sheet having the image formed on the sheet is stacked, and is lowered as stacking proceeds, wherein the ejection tray is configured to re-stack the sheet having the image formed on the sheet at a time point at which the lift tray is lowered to a re-stacking position to eject the sheet outside of the sheet discharge apparatus, wherein the system configuration image includes structure images representing the lift tray and the ejection tray that are displaced in the stacker, and wherein the display controller is configured to map and display the sheet bundle image on one of the structure images representing the lift tray and the ejection tray based on information on the order of taking out of the first sheet bundle and the second sheet bundle.

4. The control device according to claim 3, wherein, in a case where sheets stacked on the ejection tray are taken out, the display controller deletes the sheet bundle image corresponding to the sheets taken out.

5. The control device according to claim 1, wherein, in a case where a fully-stacked state of the stacking tray is detected, the sheets of the processed image forming job are divided and discharged on another stacking tray among the plurality of stacking trays.

6. The control device according to claim 1, wherein the order of taking out of the first sheet bundle and the second sheet bundle is displayed at a position corresponding to the first sheet bundle image and the second sheet bundle image.

7. The control device according to claim 1, wherein the first sheet bundle image and the second sheet bundle image are displayed, according to respective display sizes, depending on a stacking height of each of the first and second sheet bundles.

8. The control device according to claim 1, wherein the sheets of the another processed image forming job are discharged on the first stacking tray or the second stacking tray.

9. The control device according to claim 1, wherein the sheets of the another processed image forming job are discharged on a stacking tray which is different from any of the first stacking tray and the second stacking tray among the plurality of stacking trays.

10. A method for a control device for controlling a system having an image forming apparatus configured to form an image on a sheet based on an image forming job, and a sheet discharge apparatus having a stacking tray on which the sheet, having the image formed on the sheet, is to be stacked, the method comprising:

generating a system configuration image representing a configuration of the system, and generating a sheet bundle image representing a sheet bundle stacked on the stacking tray;

displaying, on a display, a screen in which the sheet bundle image is combined at a position of the stacking tray in the system configuration image; and inputting designation of an image forming job which corresponds to sheets to be taken out and which is a processing image forming job selected among processed image forming jobs included in an execution history list, wherein, in a case where the sheets of the selected image forming job are divided and discharged on a plurality of stacking trays, displaying includes:

displaying a first sheet bundle image, which represents a part of the sheets of the selected image forming job, and a second sheet bundle image, which represents a part of the sheets of the selected image forming job, in a first display color, wherein the first sheet bundle image represents a first sheet bundle stacked on a first stacking tray among the plurality of stacking trays, and wherein the second sheet bundle image represents a second sheet bundle stacked on a second stacking tray among the plurality of stacking trays, displaying a third sheet bundle image in a second display color which is different from the first display color, wherein the third sheet bundle image represents a third sheet bundle, which are stacked on one of the plurality of stacking trays, including sheets of another processed image forming job, and displaying an order of taking out of the first sheet bundle and the second sheet bundle using the first sheet bundle image, the second sheet bundle image, and the third sheet bundle image.

11. A non-transitory computer-readable storage medium storing a program to cause a computer to perform a method for a control device for controlling a system having an image forming apparatus configured to form an image on a sheet based on an image forming job, and a sheet discharge apparatus having a stacking tray on which the sheet, having the image formed on the sheet, is to be stacked, the method comprising:

generating a system configuration image representing a configuration of the system, and generating a sheet bundle image representing a sheet bundle stacked on the stacking tray;

displaying, on a display, a screen in which the sheet bundle image is combined at a position of the stacking tray in the system configuration image; and inputting designation of an image forming job which corresponds to sheets to be taken out and which is a processed image forming job selected among processed image forming jobs included in an execution history list, wherein, in a case where the sheets of the selected image forming job are divided and discharged on a plurality of stacking trays, displaying includes:

displaying a first sheet bundle image, which represents a part of the sheets of the selected image forming job, and a second sheet bundle image, which represents a part of the sheets of the selected image forming job, in a first display color, wherein the first sheet bundle image represents a first sheet bundle stacked on a first stacking tray among the plurality of stacking trays, and wherein the second sheet bundle image represents a second sheet bundle stacked on a second stacking tray among the plurality of stacking trays, displaying a third sheet bundle image in a second display color which is different from the first display color, wherein the third sheet bundle image represents a third sheet bundle, which are stacked on one of the plurality of stacking trays, including sheets of another processed image forming job, and displaying an order of taking out of the first sheet bundle and the second sheet bundle using the first sheet bundle image, the second sheet bundle image, and the third sheet bundle image.

* * * * *